US008466837B2

(12) United States Patent
Rentz et al.

(10) Patent No.: US 8,466,837 B2
(45) Date of Patent: Jun. 18, 2013

(54) HOOKED TURNSTILE ANTENNA FOR NAVIGATION AND COMMUNICATION

(75) Inventors: Mark L. Rentz, Torrance, CA (US); Liza C. Ma, Redondo Beach, CA (US)

(73) Assignee: Navcom Technology Inc., Torrance, CA (US)

( * ) Notice: Subject to any disclaimer, the term of this patent is extended or adjusted under 35 U.S.C. 154(b) by 332 days.

(21) Appl. No.: 12/392,037

(22) Filed: Feb. 24, 2009

(65) Prior Publication Data

US 2010/0164831 A1 Jul. 1, 2010

Related U.S. Application Data

(60) Provisional application No. 61/142,058, filed on Dec. 31, 2008.

(51) Int. Cl.
*H01Q 1/24* (2006.01)

(52) U.S. Cl.
USPC ..... 343/700 MS; 343/795; 343/797

(58) Field of Classification Search
USPC ..... 343/795, 797, 850, 852, 725, 727, 343/803–804, 809, 821, 853, 741, 806, 700, 343/829, 846
See application file for complete search history.

(56) References Cited

U.S. PATENT DOCUMENTS

| | | | | |
|---|---|---|---|---|
| 4,725,848 | A | 2/1988 | Honda | 343/895 |
| 4,731,877 | A | 3/1988 | Moon | |
| 4,850,034 | A | 7/1989 | Campbell | |
| 4,951,006 | A | 8/1990 | Cohen | 331/74 |
| 5,173,715 | A * | 12/1992 | Rodal et al. | 343/795 |
| 5,375,256 | A | 12/1994 | Yokoyama et al. | |
| 5,594,454 | A | 1/1997 | Devereux et al. | 342/357 |
| 5,708,446 | A * | 1/1998 | Laramie | 343/815 |
| 6,034,649 | A * | 3/2000 | Wilson et al. | 343/795 |
| 6,211,840 | B1 * | 4/2001 | Wood et al. | 343/793 |
| 6,342,867 | B1 * | 1/2002 | Bell | 343/795 |
| 6,856,287 | B2 | 2/2005 | Rao et al. | 343/700 |
| 6,919,851 | B2 | 7/2005 | Rogers et al. | 343/749 |
| 7,042,413 | B2 * | 5/2006 | Mazoki et al. | 343/795 |
| 7,176,845 | B2 | 2/2007 | Fabrega-Sanchez et al. | 343/850 |
| 7,180,467 | B2 | 2/2007 | Fabrega-Sanchez et al. | 343/861 |
| 7,190,322 | B2 | 3/2007 | Apostolos et al. | 343/841 |
| 7,274,338 | B2 | 9/2007 | Ozkar et al. | 343/793 |
| 7,274,340 | B2 | 9/2007 | Ozden et al. | |

(Continued)

FOREIGN PATENT DOCUMENTS

EP 1445872 A3 8/2004

OTHER PUBLICATIONS

International Search Report for International Application No. PCT/US09/69116, dated Feb. 25, 2010.

(Continued)

*Primary Examiner* — Tho G Phan
(74) *Attorney, Agent, or Firm* — Morgan, Lewis & Bockius LLP

(57) ABSTRACT

An antenna includes a first antenna element and a second antenna element, wherein the first antenna element and the second antenna element are both configured in a hook shape. The antenna also includes a first impedance matching circuit coupled to the first antenna element, wherein the first impedance matching circuit includes a first plurality of filters and a second impedance matching circuit coupled to the second antenna element, wherein the second impedance matching circuit includes a second plurality of filters.

20 Claims, 18 Drawing Sheets

U.S. PATENT DOCUMENTS

| | | | | |
|---|---|---|---|---|
| 7,330,153 | B2 | 2/2008 | Rentz | 343/700 |
| 7,577,464 | B2 * | 8/2009 | Ezal et al. | 455/562.1 |
| 7,710,327 | B2 * | 5/2010 | Saban et al. | 343/700 MS |
| 2005/0040994 | A1 * | 2/2005 | Mazoki et al. | 343/809 |
| 2005/0088354 | A1 * | 4/2005 | Chang | 343/767 |
| 2005/0272387 | A1 | 12/2005 | Cowley et al. | |
| 2006/0044196 | A1 | 3/2006 | Grant et al. | 343/713 |
| 2007/0046557 | A1 | 3/2007 | Chen et al. | 343/795 |
| 2007/0109198 | A1 * | 5/2007 | Saban et al. | 343/700 MS |
| 2007/0180207 | A1 * | 8/2007 | Garfinkle | 711/162 |
| 2007/0205945 | A1 | 9/2007 | Tatarnikov et al. | 343/700 |
| 2007/0236400 | A1 | 10/2007 | Rentz et al. | |
| 2007/0293150 | A1 * | 12/2007 | Ezal et al. | 455/25 |
| 2008/0042774 | A1 * | 2/2008 | Talbot | 333/33 |
| 2008/0186140 | A1 | 8/2008 | Kuwako et al. | |

OTHER PUBLICATIONS

International Search Report, PCT/US2009/035270, Aug. 17, 2009, 16 pgs.

* cited by examiner

500

510

520

530

540

550

HOOKED TURNSTILE ANTENNA FOR NAVIGATION AND COMMUNICATION

RELATED APPLICATIONS

This application claims priority under 35 U.S.C. §119 to U.S. Provisional Patent Application No. 61/142,058 filed on Dec. 31, 2008, which application is incorporated by reference herein in its entirety.

This application is related to U.S. patent application Ser. No. 12/037,908, filed Feb. 26, 2008, which application is incorporated by reference herein in its entirety.

TECHNICAL FIELD

The present invention relates generally to multi-band antennas, and more specifically, to a hook shape multi-band antenna for use in global satellite positioning and communication systems.

BACKGROUND

Receivers in global navigation satellite systems (GNSS's), such as the Global Positioning System (GPS), use range measurements that are based on line-of-sight signals broadcast by satellites. The receivers measure the time-of-arrival of one or more of the broadcast signals. This time-of-arrival measurement includes a time measurement based upon a coarse acquisition coded portion of a signal, called pseudorange, and a phase measurement.

In GPS, signals broadcast by the satellites have frequencies that are in one or several frequency bands, including an L1 band (1565 to 1585 MHz), an L2 band (1217 to 1237 MHz), an L5 band (1164 to 1189 MHz) and L-band communications (1525 to 1560 MHz). Other GNSS's broadcast signals in similar frequency bands. In order to receive one or more of the broadcast signals, receivers in GNSS's often have multiple antennas corresponding to the frequency bands of the signals broadcast by the satellites. Multiple antennas, and the related front-end electronics, add to the complexity and expense of receivers in GNSS's. In addition, the use of multiple antennas that are physically displaced with respect to one another may degrade the accuracy of the range measurements, and thus the position fix, determined by the receiver. Further, in automotive, agricultural, and industrial applications it is desirable to have a compact, rugged navigation receiver. Such a compact and rugged receiver may be mounted inside or outside a vehicle, depending on the application.

The ideal antenna for the reception of signals from GPS satellites would have a gain of 3 dB isotropic for the upper hemisphere, which sees the sky, and no gain for the lower hemisphere, which sees the earth. Additionally it would have a polarization of right hand circular (RHCP). In recent years other GNSS have supplemented the GPS signals, and their signals are best received with the same gain pattern and polarization of the ideal GPS antenna. Sometimes the accuracy of these GNSS signals are enhanced with differential corrections generated by reference receivers and transmitted on satellite downlinks at frequencies slightly lower than GPS L1. Fortunately these correction signals are also RHCP, but they tend to be of lower power and are available from fewer satellites than the GNSS signals. All together, these GNSS and communication bands cover from 1150 MHz to 1610 MHz in frequency.

Various attempts to receive all of these frequencies with an RHCP antenna having the desired gain pattern, and a moderate cost and size have been made. Most of these have gain patterns which are quite good at high elevation angles (i.e. close to straight up), but drop rapidly closer to the horizon.

There is a need, therefore, for improved compact antennas for use in receivers in GNSS's to address the problems associated with existing antennas.

SUMMARY

Some embodiments provide an antenna including a first antenna element and a second antenna element, wherein the first antenna element and the second antenna element are both configured in a hook shape. The antenna also includes a first impedance matching circuit coupled to the first antenna element, wherein the first impedance matching circuit includes a first plurality of filters and a second impedance matching circuit coupled to the second antenna element, wherein the second impedance matching circuit includes a second plurality of filters.

In some embodiments, the antenna includes a ground plane. In these embodiments, a respective antenna element includes: a first segment substantially perpendicular to the ground plane, a second segment coupled to the first segment and substantially parallel to the ground plane, a third segment coupled to the second segment and substantially perpendicular to the ground plane, and a fourth segment coupled to the third segment and substantially parallel to the ground plane.

In some embodiments, a respective impedance matching circuit includes: a low pass filter and a high pass filter.

In some embodiments, the low pass filter and the high pass filter are coupled in series.

In some embodiments, the respective impedance matching circuit provides an impedance of substantially 50 Ohms at a center frequency of both a first frequency band and a second, higher frequency band.

In some embodiments, the antenna includes a ground plane and the first antenna element and second antenna element each have a radiating element having a predefined extent substantially parallel to the ground plane. In the embodiments, the hook shape increases the gain of signals received at elevations substantially at the horizon relative to an antenna having inverted-L shaped antenna elements with radiating elements that have the same predefined extent substantially parallel to a ground plane.

In some embodiments, the antenna includes a feed network circuit coupled to the first impedance matching circuit and the second impedance matching circuit, wherein the feed network circuit has a combined output corresponding to the signals received by the first antenna element and the second antenna element.

In some embodiments, a respective antenna element includes an insulating substrate having a specified thickness and a specified dielectric constant, and conducting material on both sides of the insulating substrate.

In some embodiments, the first antenna element and the second antenna element are arranged substantially along a first axis of the antenna.

In some embodiments, the antenna includes a third antenna element and a fourth antenna element, wherein the third antenna element and the fourth antenna element are both configured in the hook shape. The antenna also includes a third impedance matching circuit coupled to the third antenna element, wherein the third impedance matching circuit includes a third plurality of filters, and a fourth impedance matching circuit coupled to the fourth antenna element, wherein the fourth impedance matching circuit includes a fourth plurality of filters.

In some embodiments, the first antenna element and the second antenna element are arranged substantially along a first axis of the antenna. The third antenna element and the fourth antenna element are arranged substantially along a second axis of the antenna.

In some embodiments, the first axis and the second axis are substantially perpendicular to each other.

In some embodiments, the antenna includes a feed network circuit coupled to the first impedance matching circuit, the second impedance matching circuit, the third impedance matching circuit, and the fourth impedance matching circuit, wherein the feed network circuit has a combined output corresponding to the signals received by the first antenna element, the second antenna element, the third antenna element, and the fourth antenna element.

In some embodiments, the feed network circuit is configured to phase shift received signals from a respective antenna element relative to received signals from neighboring antenna elements in the antenna by substantially 90 degrees.

In some embodiments, the first antenna element, the second antenna element, the third antenna element, and the fourth antenna element are configured to receive radiation that is circularly polarized.

In some embodiments, the radiation is right hand circularly polarized radiation.

Some embodiments provide a system including an antenna, an impedance matching circuit, a feed network circuit, a low-noise amplifier, and a sampling circuit. The antenna includes a plurality of antenna elements each configured in a hook shape. The impedance matching circuit is coupled to the antenna, wherein the impedance matching circuit comprises a plurality of filters. The feed network circuit is coupled to the impedance matching circuit. The low-noise amplifier is coupled to the feed network circuit. The sampling circuit is coupled to the low-noise amplifier output.

BRIEF DESCRIPTION OF THE DRAWINGS

Like reference numerals refer to corresponding parts throughout the drawings.

DESCRIPTION OF EMBODIMENTS

Figure 1A:
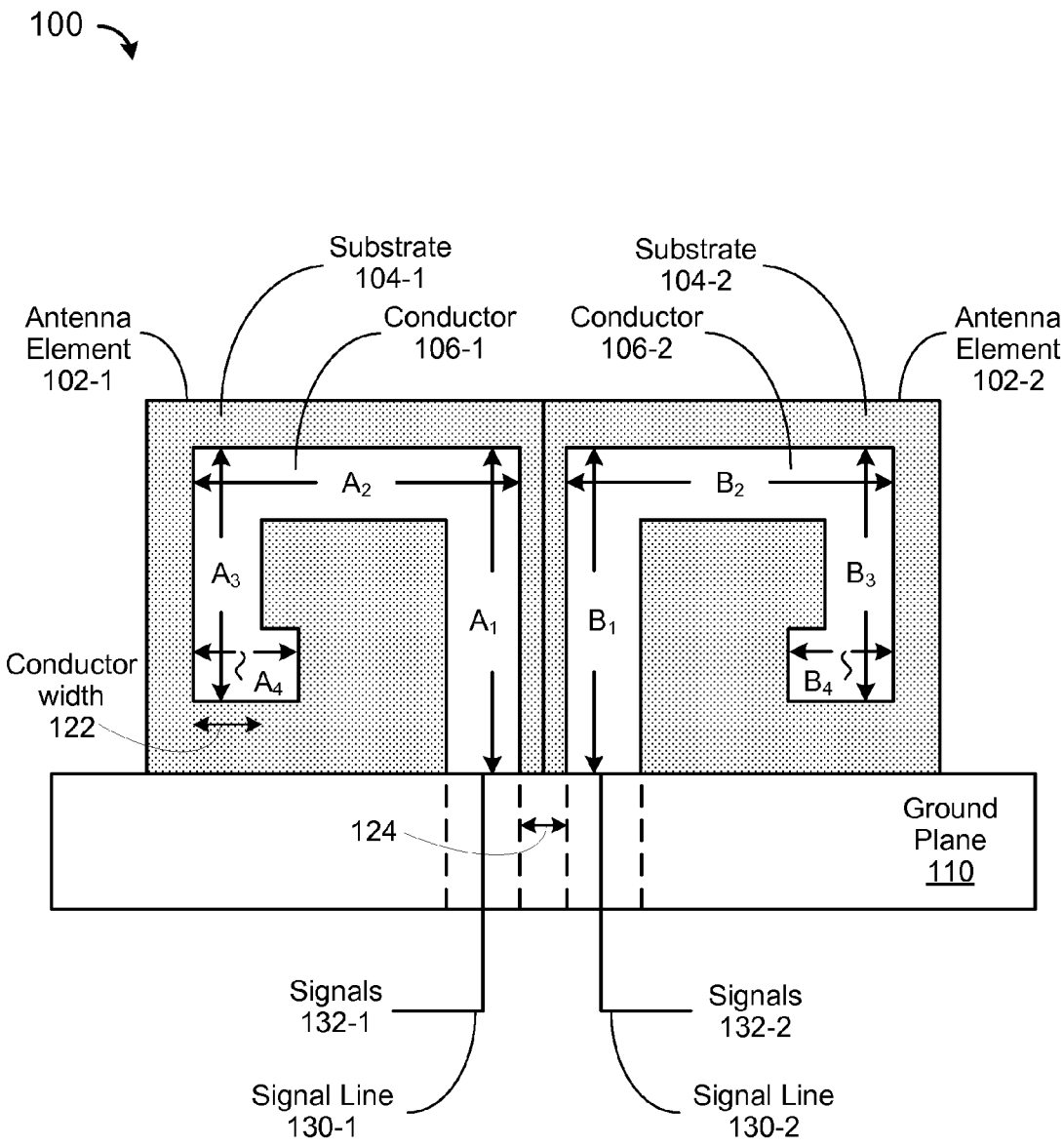
FIG. 1A is a block diagram illustrating a side view of a hook shape multi-band antenna, according to some embodiments.

Reference will now be made in detail to embodiments of the invention, examples of which are illustrated in the accompanying drawings. In the following detailed description, numerous specific details are set forth in order to provide a thorough understanding of the present invention. However, it will be apparent to one of ordinary skill in the art that the present invention may be practiced without these specific details. In other instances, well-known methods, procedures, components, and circuits have not been described in detail so as not to unnecessarily obscure aspects of the present invention.

In this document, the terms "substantially parallel" and "substantially perpendicular" mean within five degrees (5°) of parallel or perpendicular, respectively; the term "substantially along" a particular axis means within ten degrees (10°) of the axis; the term "substantially constant impedance" means that the magnitude of the impedance varies by less than 10 percent; the term "frequency band is substantially passed" means that signals in the frequency band are attenuated in magnitude by less than 1 dB (26 percent). Values and measurements said to be "approximate" are herein defined to be within fifteen percent (15%) of the stated values or measurements.

In some embodiments, a hook shape multi-band antenna achieves a gain pattern which is more uniform in gain with respect to elevation in the upper hemisphere than a comparably sized inverted-L shape antenna, while having low gain in the lower hemisphere. The physical height of the hook shape multi-band antenna is minimized by the hook shape of the antenna elements and by the high dielectric constant of the substrate material on which the antenna elements are deposited. In some embodiments, the hook shape multi-band antenna is configured to transmit and/or receive a right hand circularly polarized (RHCP) radiation by having four identical antenna elements and a quadrature feed network circuit. Although the gain pattern is relatively uniform over the frequency bands of interest, the impedance of the antenna is not constant and is not the typical 50 ohms. Thus, in some embodiments, an impedance matching network is used on each of the four antenna elements to transform the impedance of the antenna elements at the frequency bands of interest to approximately 50 Ohms (e.g., 50 Ohms±20 Ohms) so that the signals can be transferred and processed by conventional circuitry.

The hook shape multi-band antenna covers a range of frequencies that may be too far apart to be covered using a single existing antenna. In an exemplary embodiment, the hook shape multi-band antenna is used to transmit and/or receive signal in the L1 band (1565 to 1585 MHz), the L2 band (1217 to 1237 MHz), the L5 band (1164 to 1189 MHz) and L-band communications (1525 to 1560 MHz). These four L-bands are treated as two distinct bands of frequencies: a first band of frequencies that ranges from approximately 1160 to 1252 MHz, and a second band of frequencies that ranges from approximately 1525 to 1610 MHz. Approximately center frequencies of these two bands are located at 1206 MHz ($f_1$) and 1567 MHz ($f_2$). These specific frequencies and frequency bands are only exemplary, and other frequencies and frequency bands may be used in other embodiments.

In some embodiments, the hook shape multi-band antenna is configured to have substantially constant impedance (sometimes called a common impedance) in the first band and the second band of frequencies. These characteristics may allow receivers in GNSS's, such as GPS, to use fewer or even one antenna to receive signals in multiple frequency bands.

While embodiments of a hook shape multi-band antenna for GPS are used as illustrative examples in the discussion that follows, it should be understood that the hook shape multi-band antenna may be applied in a variety of applications, including wireless communication, cellular telephony, as well as other GNSS's. The techniques described herein may be applied broadly to a variety of antenna types and designs for use in different ranges of frequencies.

Figure 1B:
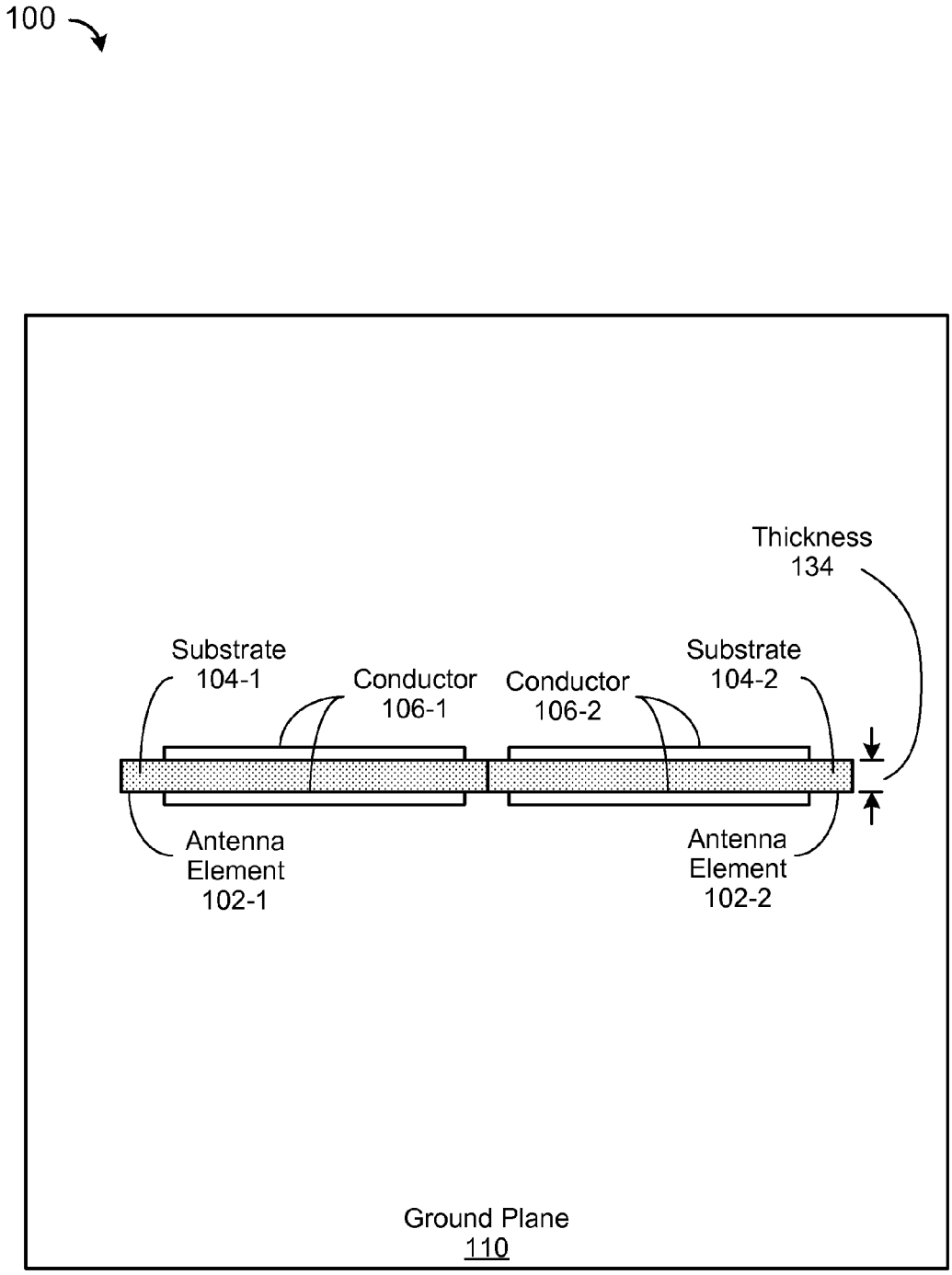
FIG. 1B is a block diagram illustrating a top view of a hook shape multi-band antenna, according to some embodiments.

Attention is now directed towards embodiments of the hook shape multi-band antenna. FIGS. 1A and 1B are block diagrams illustrating side and top views of a hook shape multi-band antenna 100, according to some embodiments. The hook shape multi-band antenna 100 includes a ground plane 110 and two hook shape antenna elements 102. The hook shape antenna elements 102 are arranged substantially along a first axis of the hook shape multi-band antenna 100. In some embodiments, the conductors 106 are deposited onto substrates 104 to form the hook shape antenna elements 102. For example, the conductors 106 may be a metal layer deposited onto the substrates 104 using standard printed circuit board (PCB) manufacturing techniques. In some embodiments, the conductors 106 are deposited on both sides of the substrates 104, and have width 122. The electrical signals 132 are coupled to and from the hook shape antenna elements 102 using signal lines 130. In some embodiments, the signal lines 130 are coaxial cables and the ground plane 110 is a metal layer (e.g., in or on a PCB) suitable for micro-wave applications.

Each of the hook shape antenna elements 102 have a total length of $A_1+A_2+A_3+A_4$ (e.g., a first segment, a second segment, a third segment, and a fourth segment of the antenna element 102, respectively) and $B_1+B_2+B_3+B_4$, respectively. Note that segments $A_1$, $A_3$, $B_1$, and $B_3$ are substantially perpendicular to the ground plane 110 and segments $A_2$, $A_4$, $B_2$, and $B_4$ are substantially parallel to the ground plane 110. Also note that "substantially parallel" is used to refer to angles within ten degrees of parallel and that "substantially perpendicular" is used to refer to angles within ten degrees of perpendicular. Referring to FIG. 1B, the substrates 104 have a specified thickness 134 and a specified dielectric constant. In some embodiments, the specified thickness 134 is approximately 0.05 inches and the dielectric constant is approximately 10.2. For example, the material RO3210 from the Rogers Corporation may be used for the substrates 104. In some embodiments, the height (e.g., $A_1$ or $B_1$) of a respective hook shape antenna element 102 is approximately 1.9 inches. Note that to achieve an equivalent gain pattern with more conventional low dielectric constant materials would require the height of the elements to be increased by approximately 50 percent.

Another feature of the hook shape antenna elements 102 is the fourth segments of the hook shape antenna elements 102 (e.g., $A_4$ and $B_4$), which turns toward the central Z-axis. These segments have the effect of pulling the gain pattern downward, hence increasing the gain at elevations closer to the horizon. Additionally, these segments add length to the antenna elements, hence improving its efficiency and extending its response to lower frequencies.

In some embodiments, the hook shape multi-band antenna 100 may include additional components or fewer components. Functions of two or more components may be combined. Positions of one or more components may be modified.

In some embodiments, the hook shape multi-band antenna 100 (FIGS. 1A and 1B) may include additional hook shape antenna elements. These embodiments are illustrated in FIGS. 2A and 2B.

Figure 2A:
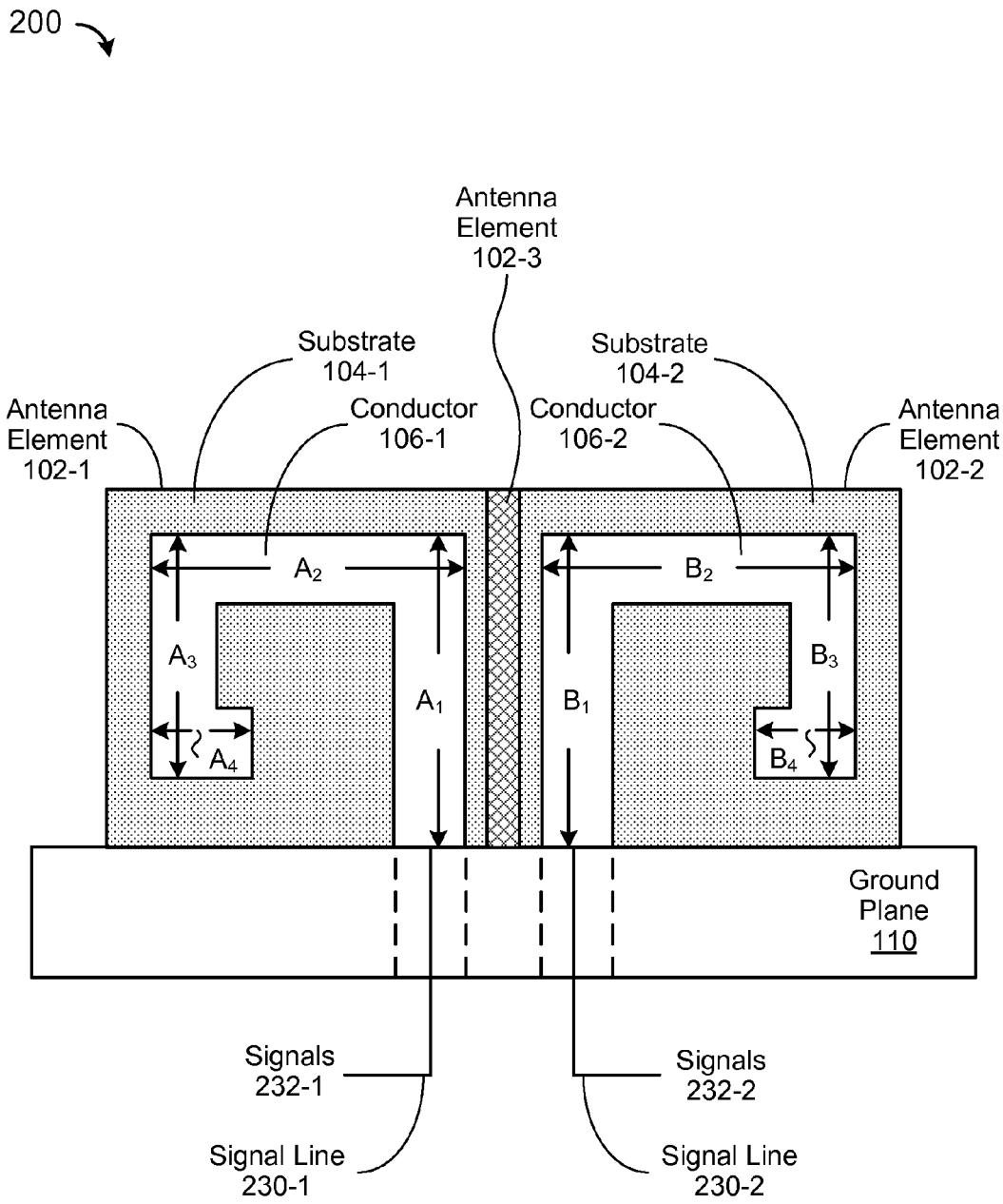
FIG. 2A is a block diagram illustrating a side view of a quad hook shape multi-band antenna, according to some embodiments.
Figure 2B:
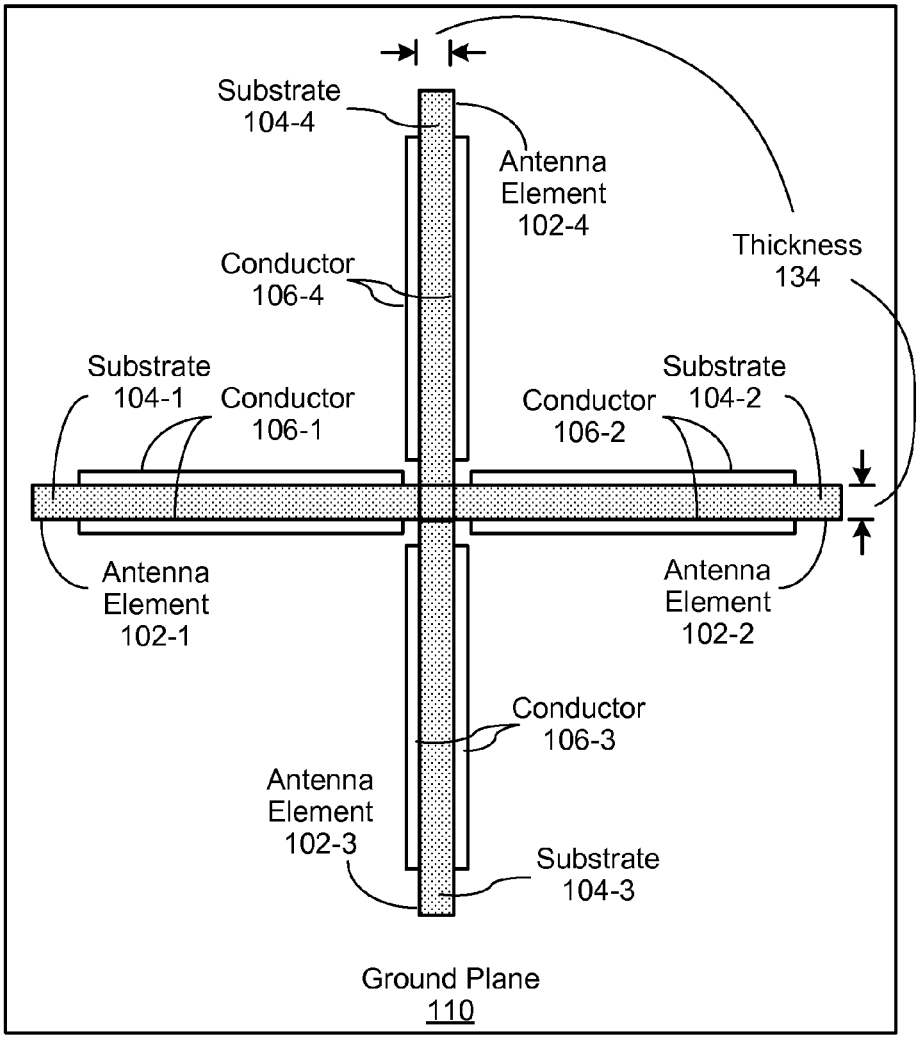
FIG. 2B is a block diagram illustrating a top view of a quad hook shape multi-band antenna, according to some embodiments.

FIGS. 2A and 2B are block diagrams illustrating a side view and a top view of a quad hook shape multi-band antenna 200, according to some embodiments. FIGS. 2A and 2B illustrate an embodiment of the quad hook shape multi-band antenna 200 having four hook shape antenna elements 102-1 to 102-4. FIG. 2A shows a side view of the quad hook shape multi-band antenna 200. Note that only three hook shape antenna elements 102 are visible because of the side view, but four are present. FIG. 2B shows a top view of the quad hook shape multi-band antenna 200, with four hook shape antenna elements 102-1 to 102-4. Each hook shape antenna element 102 has a thickness 134. The hook shape antenna elements 102-1 and 102-2 are arranged substantially along the first axis of the quad hook shape multi-band antenna 200. The hook shape antenna elements 102-3 and 102-4 are arranged substantially along a second axis of the quad hook shape multi-band antenna 200. The second axis is substantially perpendicular to (rotated by approximately 90° with respect to) the first axis. In some embodiments, the conductors 106-1 to 106-4 are deposited onto substrates 104-1 to 104-4 to form the hook shape antenna elements 102-1 to 102-4. For example, the conductors 106 may be a metal layer deposited onto the substrates 104 using standard printed circuit board (PCB) manufacturing techniques. The quad electrical signals 232 are coupled to and from the hook shape antenna elements 102 using quad signal lines 230. In some embodiments, the quad signal lines 230 are coaxial cables and the ground plane 110 is a metal layer (e.g., in or on a PCB) suitable for micro-wave applications. Note that only two of the four quad signals 232 and two of the four quad signal lines 230 are shown, but four are present.

As discussed above, each of the hook shape antenna elements 102 have a total length of $A_1+A_2+A_3+A_4$ and $B_1+B_2+B_3+B_4$, respectively. Furthermore, the substrates 104 have a specified thickness 134 and a specified dielectric constant, as discussed above.

Figure 2C:
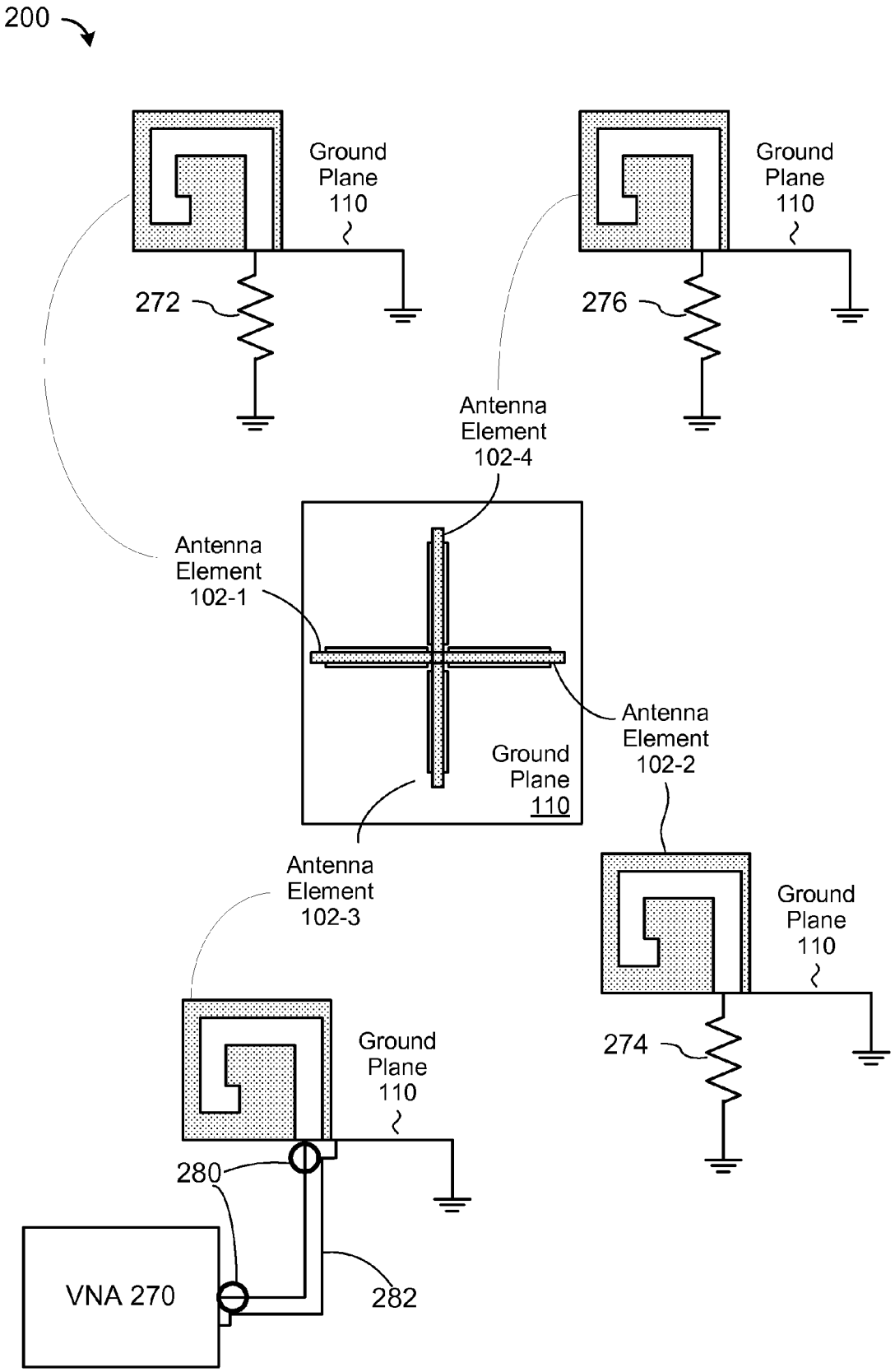
FIG. 2C is a block diagram illustrating apparatus for testing of a quad hook shape multi-band antenna, using a vector network analyzer, according to some embodiments.

FIG. 2C shows a block diagram illustrating apparatus for testing the quad hook shape multi-band antenna 200, using a vector network analyzer 270. The hook shape antenna element under test (102-3) is connected via shielded cable 280 (with shield 282) to the vector network analyzer 270. Each of the other hook shape antenna elements (102-1, 102-2, and 102-4) are coupled to one end of a respective resistor 272, 274, and 276 (the other end of which is coupled to a voltage source, such as circuit ground). In some embodiments, each of the resistors 272, 274, and 276 has a resistance of 50 Ohms, or approximately 50 Ohms (e.g., 50 Ohms plus or minus 0.5 Ohms).

Figure 3A:
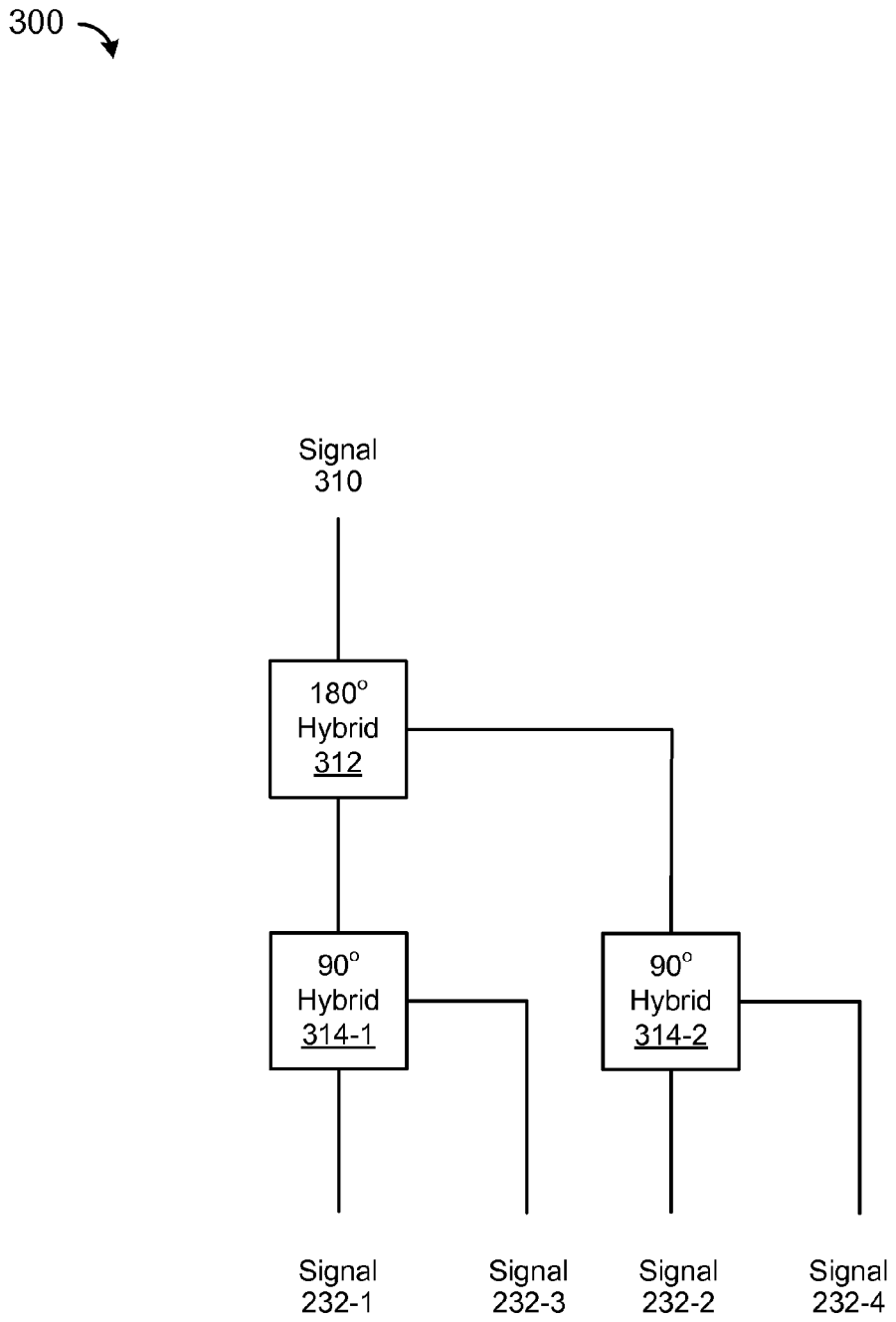
FIG. 3A is a block diagram illustrating a feed network circuit for a multi-band antenna, according to some embodiments.

FIG. 3A is a block diagram illustrating a feed network circuit 300 for the quad hook shape multi-band antenna 200, according to some embodiments. The feed network circuit 300 may be coupled to the quad hook shape multi-band antenna 200 (FIGS. 2A and 2B) to provide appropriately phased electrical signals 310 to the hook shape antenna elements 102.

In a transmit embodiment, a 180° hybrid circuit 312 accepts an input electrical signal 310 and outputs two electrical signals that are approximately 180° out of phase with respect to one another. Each of these electrical signals is coupled to one of the 90° hybrid circuits 314. Each 90° hybrid circuit 314 outputs two electrical signals 232. A respective electrical signal, such as electrical signal 232-1, may therefore have a phase shift of approximately 90° with respect to adjacent electrical signals 232. In this configuration, the feed network circuit 300 is referred to as a quadrature feed network circuit. The phase configuration of the electrical signals 232 results in the quad hook shape multi-band antenna 200 (FIGS. 2A and 2B) having a circularly polarized radiation pattern. The radiation may be right hand circularly polarized (RHCP) or left hand circularly polarized (LHCP). Note that the closer the relative phase shifts of the electrical signals 232 are to 90° and the more evenly the amplitudes of the electrical signals 232 match each other, the better the axial ratio of the quad hook shape multi-band antenna 200 (FIGS. 2A and 2B) will be.

In a receive embodiment, the electrical signals 232 are received by the hook shape antenna elements 102, and are combined through the feed network circuit 300, resulting in signal 310 which is provided to a receive circuit for processing. Note, the receive embodiment is the same as the transmit embodiment, but signals are processed in the opposite direction (receive, instead of transmit) as described later.

Figure 3B:
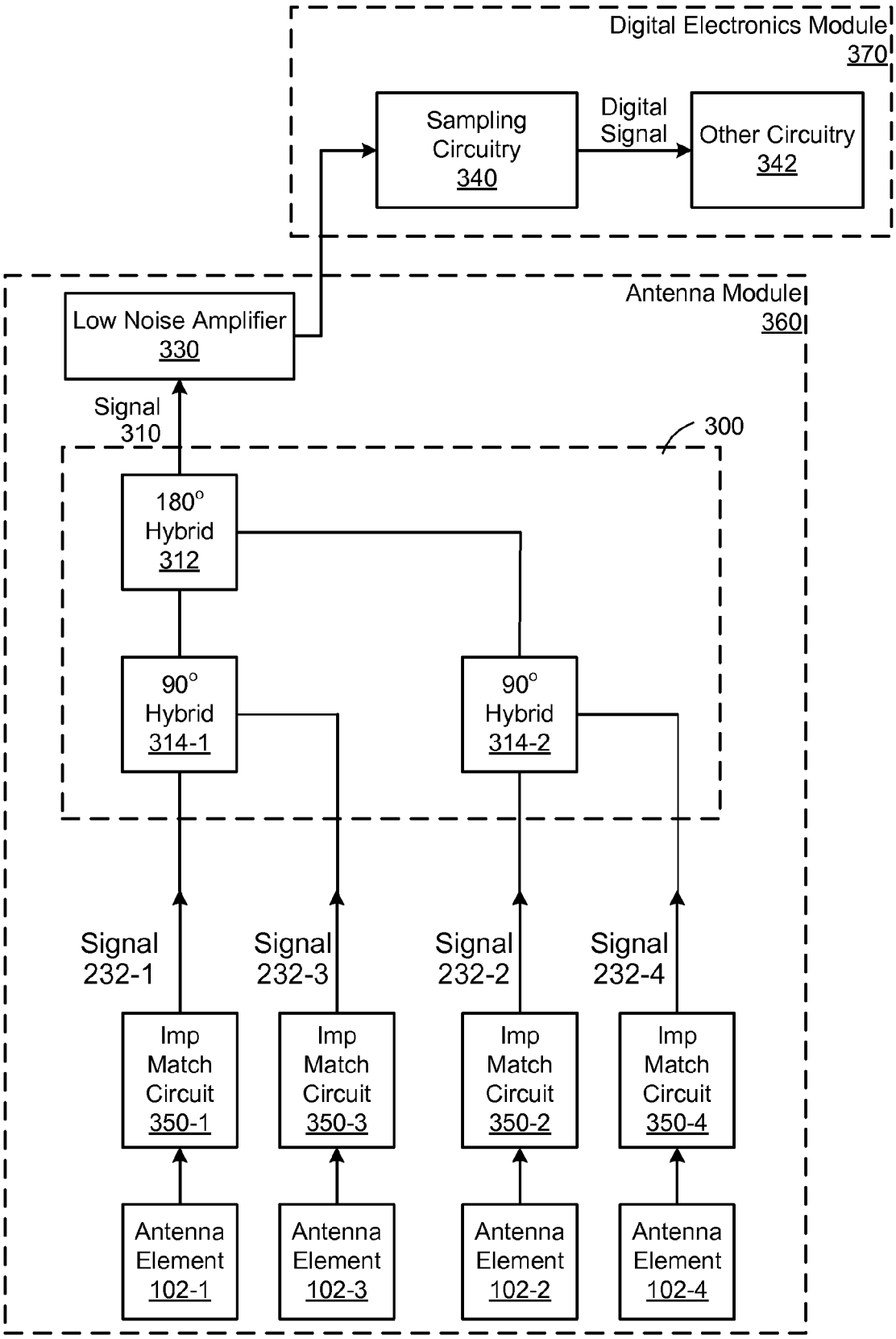
FIG. 3B is a block diagram illustrating a multi-band antenna system having a feed network, a low noise amplifier, and a digital electronics module, according to some embodiments.

FIG. 3B is a block diagram illustrating a multi-band antenna system having the feed network circuit 300, a low noise amplifier 330, and a digital electronics module 370, according to some embodiments. FIG. 3B shows an antenna module 360, comprising four hook shape antenna elements 102 (102-1 to 102-4) coupled to four respective impedance matching circuits 350 (350-1 to 350-4, respectively). The impedance matching circuits 350 provide quad electrical signals 232 to the feed network circuit 300 (e.g., FIG. 3A). The feed network circuit 300 provides combined signal 310 to the low noise amplifier 330. The function of the low noise amplifier 330 is to amplify the weak received signals without introducing (or introducing only minimal or nominal) distortion or noise. The output of the low noise amplifier 330 is coupled to the digital electronics module 370, which includes sampling circuitry 340 and other circuitry 342. In some embodiments, the sampling circuitry 340 includes an analog-to-digital (A/D) converter (ADC) and may include frequency translation circuitry such as downconverters. For example, the other circuitry 342 may include digital signal processing (DSP) circuits, memory, a microprocessor, and one or more communication interfaces for conveying information to other devices. In an embodiment, the digital electronics module 370 processes a received signal to determine a location. In an embodiment, the antenna module 360 is on a single compact circuit board, and is packaged in a manner suitable for use in outdoor and harsh environments.

Figure 3C:
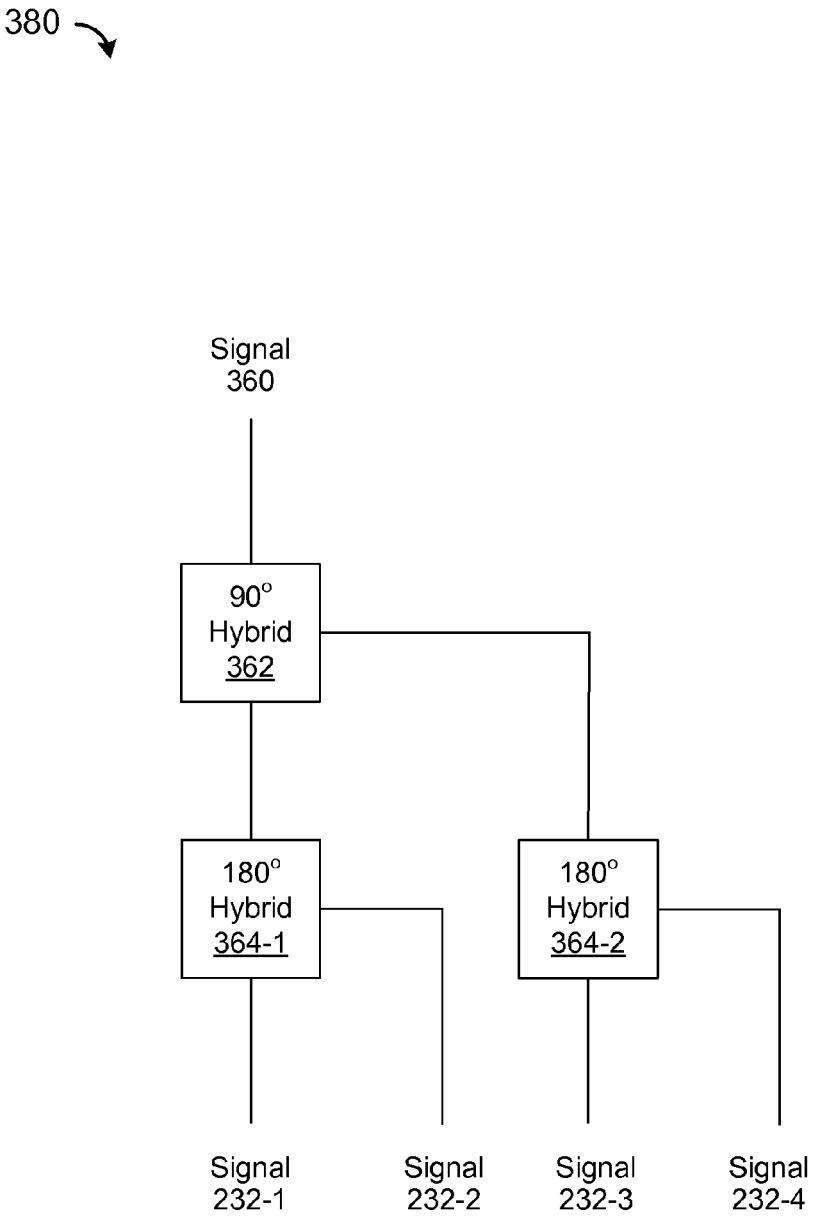
FIG. 3C is a block diagram illustrating another feed network circuit for a quad hook shape multi-band antenna, according to some embodiments.

FIG. 3C is a block diagram illustrating an alternative feed network circuit 380 for a quad hook shape multi-band antenna, according to some embodiments. In the feed network circuit 380, the quad signals 232 (232-1 to 232-4) are coupled to a first set of 180° hybrid circuits (sometimes called phase shifters) 364. The 180° hybrid circuits are coupled to a 90° hybrid circuit (sometimes called a phase shifter) 362. The 90° hybrid circuit 362 is also coupled to a combined signal 310. As with the feed network circuit 300, the feed network circuit 380 may be used in either a receive mode or transmit mode.

In some embodiments, the feed network circuit 300 or 380 may include additional components or fewer components. Functions of two or more components may be combined. Positions of one or more components may be modified.

Attention is now directed towards illustrative embodiments of the multi-band antenna and phase relationships that occur in the two or more frequency bands of interest. While the discussion focuses on the quad hook shape multi-band antenna 200 (FIGS. 2A and 2B), it should be understood that the approach may be applied to other antenna embodiments.

Referring to FIGS. 2A and 2B, the geometry of the hook shape antenna elements 102 may be determined based on a wavelength $\lambda$ (in vacuum) corresponding to the first band of frequencies, such as a central frequency $f_1$ of the first band of frequencies. (The wavelength $\lambda$ of the central frequency $f_1$ is equal to $c/f_1$, where c is the speed of light in vacuum.) In some embodiments, the hook shape antenna elements 102 are supported by printed circuit boards that are substantially perpendicular to the ground plane 110. For example, the hook shape antenna elements 102 may be metal layer conductors 106 deposited on printed circuit boards 104 that are mounted perpendicular to the ground plane 110, thereby implementing the geometry illustrated in FIGS. 1 and 2. In some embodiments, the printed circuit board material is 0.05 inch thick Rogers RO3210, which is a printed circuit board material suitable for microwave applications (it has a low loss characteristic and its dielectric constant $\in$ of 10.2 is very consistent). Using FIGS. 1A, 1B, 2A, and 2B as an illustration, the length $A_1$ (and $B_1$) is 1.8 inches, $A_2$ (and $B_2$) is 1.8 inches, $A_3$ (and $B_3$) is 1.4 inches, $A_4$ (and $B_4$) is 0.6 inches, the width 122 of the conductors 106 is 0.4 inches, the spacing between the conductors 124 is 0.375 inches, and the printed circuit board thickness 134 is 0.05 inches. Note that these values for $A_1/B_1$ to $A_4/B_4$ are prophetic values that were obtained from a computer-based electromagnetic simulator to produce the desired frequency response in the GNSS frequency ranges described above.

If a substrate with a lower dielectric constant $\in$ is used, and a similar gain versus elevation pattern is desired, the lengths of the conductors 106 of the hook shape antenna elements 102 will be larger for a given central frequency $f_1$. The exact dimensions would have to be determined either by experiment or by a computer-based electromagnetic simulator. Note that the separation distance 124 between antenna elements 102 is approximately independent of ∈.

Figure 4A:
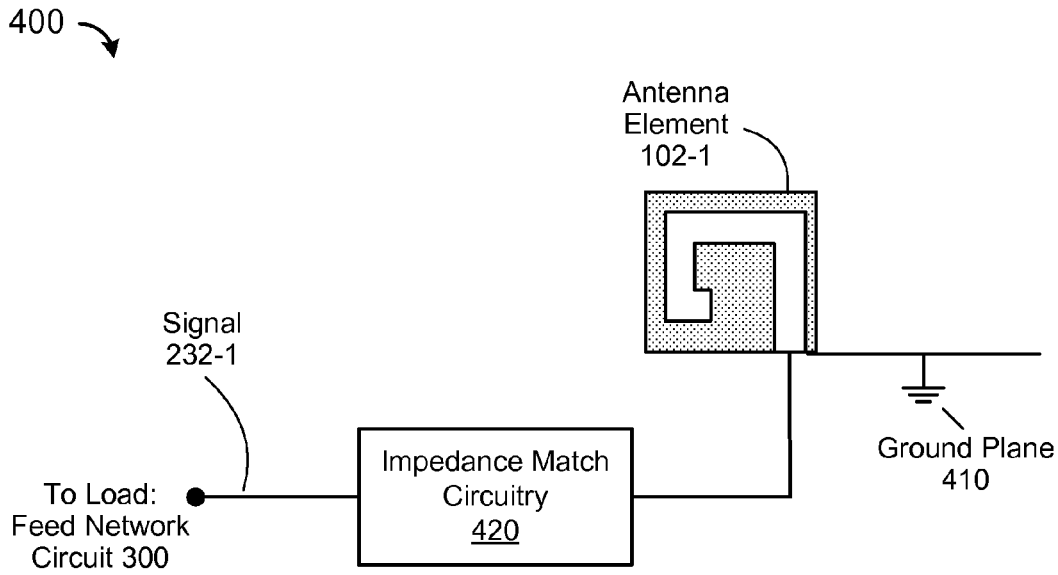
FIG. 4A is a block diagram of an impedance matching circuit having a shared element for a multi-band antenna, according to some embodiments.

FIG. 4A is a block diagram 400 of an impedance matching circuit 420, for a hook shape multi-band antenna, according to some embodiments. The impedance matching circuit 420 is coupled to the feed network circuit 300, and the hook shape antenna element 102-1, situated over ground plane 410. The impedance matching circuit 420 "matches" the impedance (or more accurately, reduces impedance mismatch) between the hook shape antenna element 102-1 and the load (e.g., the feed network circuit 300) to minimize (or reduce) reflections and maximize (or improve) energy transfer. The electrical signal 232-1 is coupled between the feed network circuit 300 and the impedance matching circuit 420.

Figure 4B:
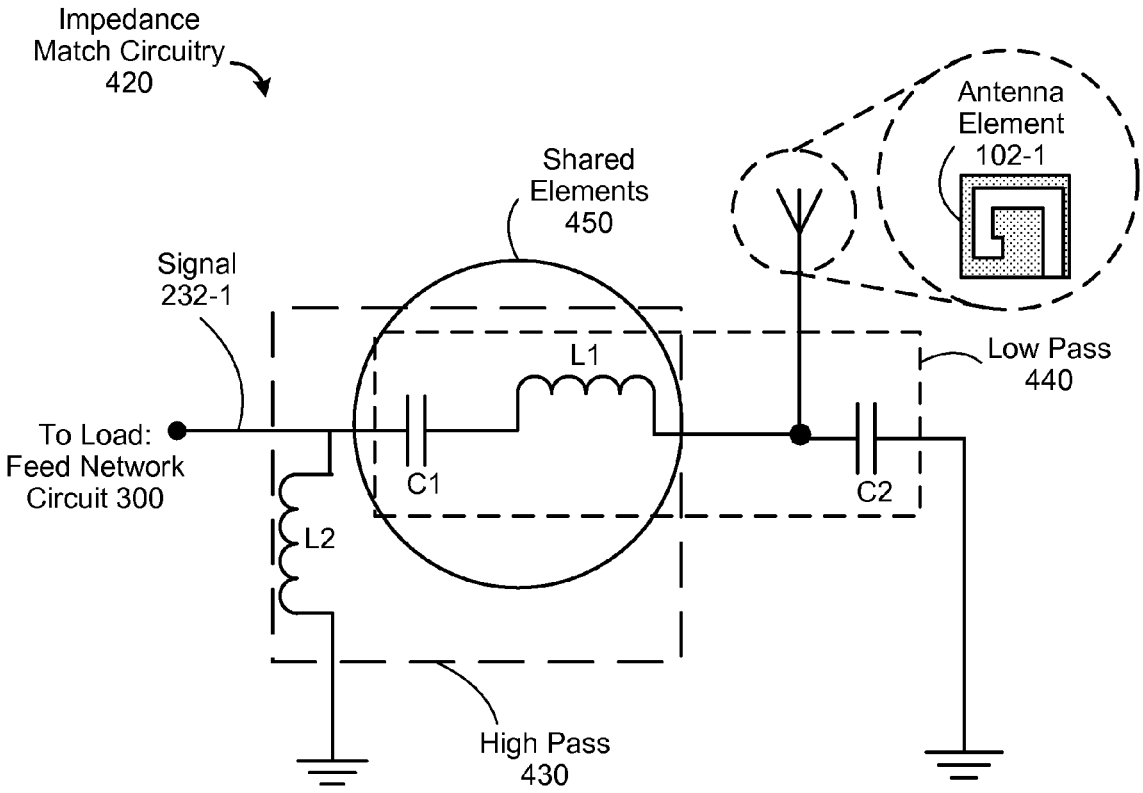
FIG. 4B is a circuit diagram of an impedance matching circuit having a plurality of filters with shared elements, according to some embodiments.

FIG. 4B is a circuit diagram of the impedance matching circuit 420 having a plurality of filters with shared elements for a hook shape multi-band antenna, according to some embodiments. In this embodiment, the impedance matching circuit 420 comprises a high pass filter 430 coupled in series with a low pass filter 440. The high pass filter 430 comprises a parallel inductor (L2) to ground, and a capacitor (C1) and inductor (L1) connected in series. The low pass filter 440 comprises a capacitor (C2) to ground, and the capacitor (C1) and inductor (L1) connected in series. Thus, the high pass filter 430 and the low pass filter 440 have shared elements 450, namely the series capacitor (C1) and inductor (L1). The electrical signal 232-1 is coupled between the load, the feed network circuit 300, and the parallel L2 inductor and the series C1 capacitor of the impedance matching circuit 420. In some embodiments, the sizes of the elements in the impedance matching circuit 420 are approximately as follows: capacitor C1: 1.8 pF, inductor L1: 6.2 nH, capacitor C2: 1.2 pF, and inductor L2: 3.9 nH. Of course, many other sets of component values may be used in other embodiments. In these embodiments, the impedance matching circuit 420 results in signal reflectance by the antenna elements 102, within the first and second frequency bands 612-1 and 612-2 shown in FIG. 6, having a magnitude of less than 10%.

Figure 5A:
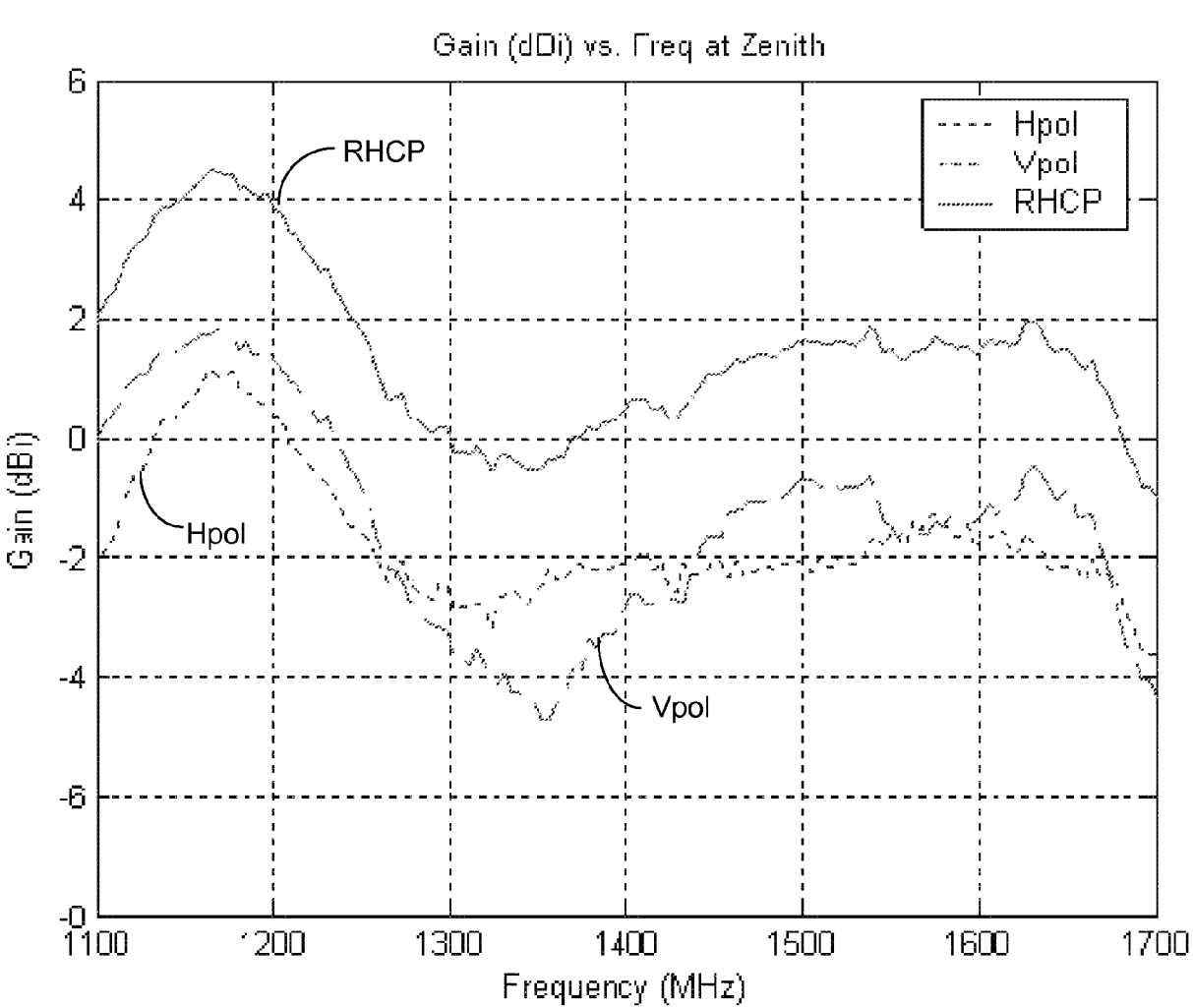
FIG. 5A is a graph of gain versus frequency at zenith for an exemplary hook shape multi-band antenna, according to some embodiments.

FIG. 5A is a graph 500 of gain versus frequency at zenith for an exemplary hook shape multi-band antenna, according to some embodiments. The circular polarization response (RHCP) was derived by combining two sets of orthogonal linear polarization responses (Hpol and Vpol, corresponding to polarizations of the electric field). The measurements illustrated in the graph 500 were taken with the source at zenith (e.g., directly above the exemplary hook shape multi-band antenna). It has been determined through measurements that the variation of gain with respect to frequency changes very little with incident angle. The graph 500 reflects the two-band nature of the impedance transformation network (e.g., impedance match circuitry 420), and shows that the hook shape multi-band antenna is more efficient (has higher gain) at lower frequencies than higher frequencies. The graph 530 in FIG. 5D illustrates gain versus frequency at zenith for a similarly sized inverted-L antenna.

Figure 5B:
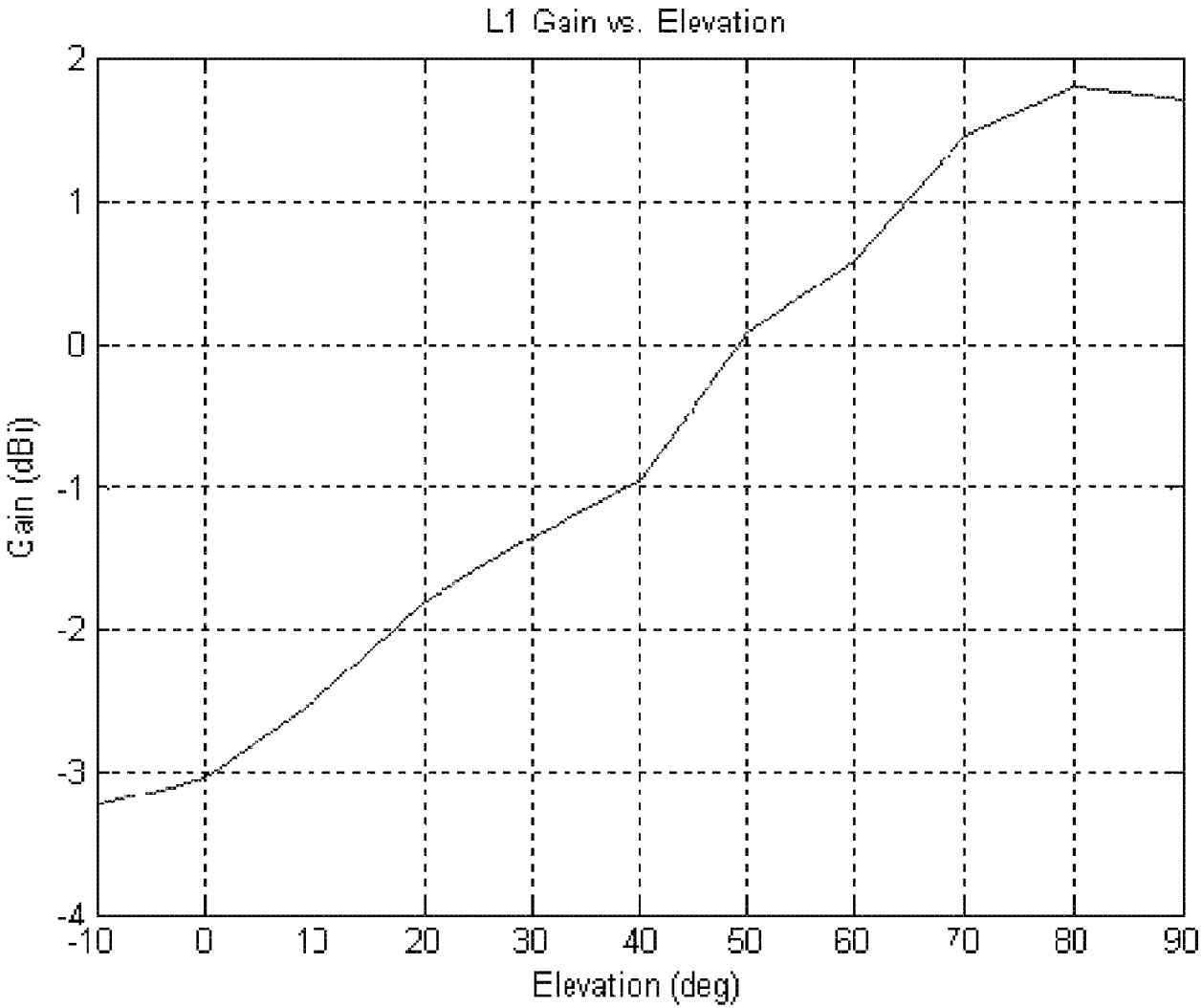
FIG. 5B is a graph of L1 gain versus elevation for an exemplary hook shape multi-band antenna, according to some embodiments.

FIG. 5B is a graph 510 of the L1 gain (i.e., gain in the L1 band) versus elevation for an exemplary hook shape multi-band antenna, according to some embodiments. The graph 510 illustrates how the isotropic RHCP gain varies as a function of elevation angle. It can be seen that the gain is maximum at zenith (90 degrees) and decreases down to approximately −3 dBi at the horizon (0 degrees). A similarly sized inverted-L antenna has a gain (in the L1 band) closer to −4 dBi at the horizon, as illustrated in graph 540 in FIG. 5E.

Figure 5C:
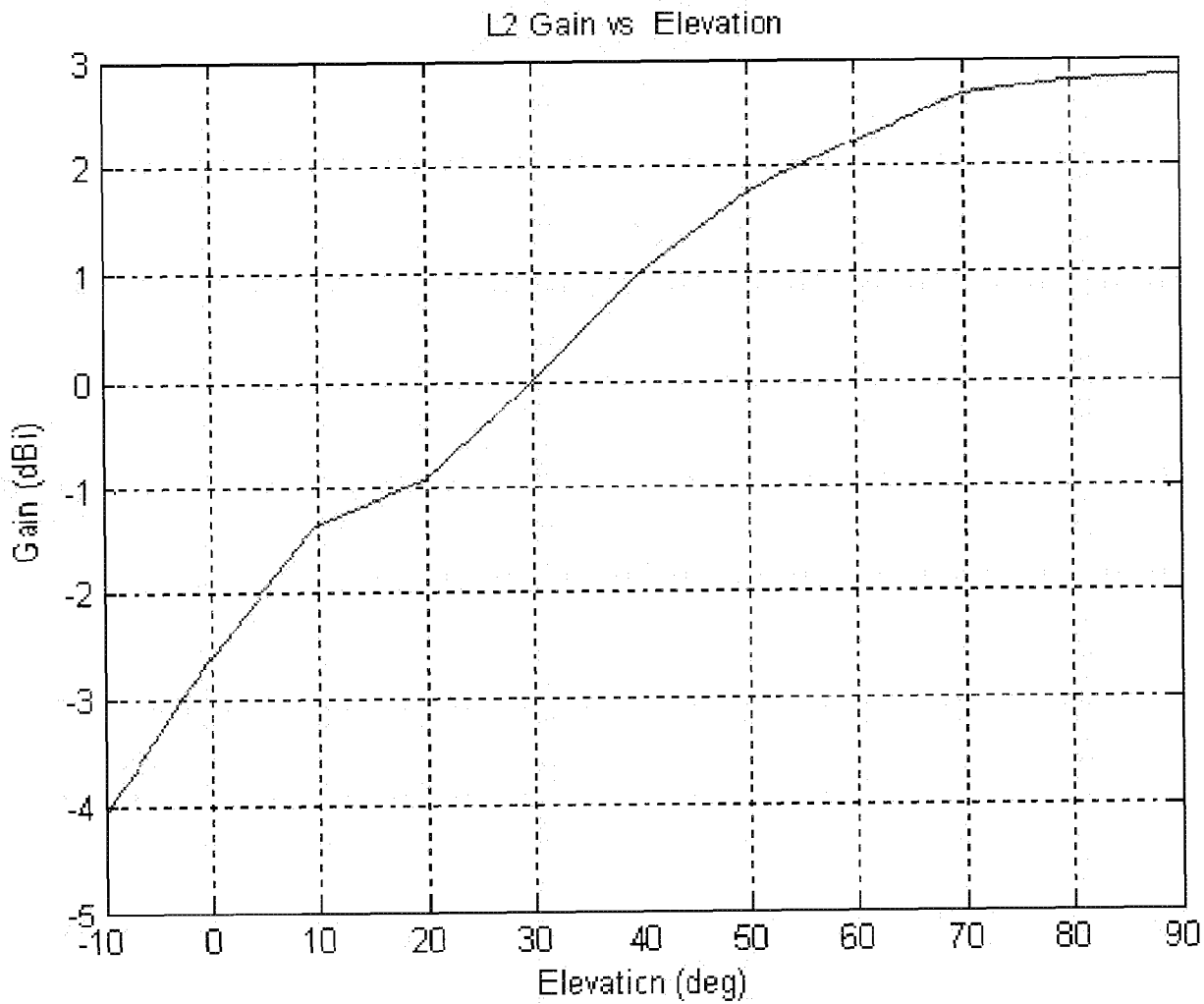
FIG. 5C is a graph of the L2 gain versus elevation for an exemplary hook shape multi-band antenna, according to some embodiments.
Figure 5D:
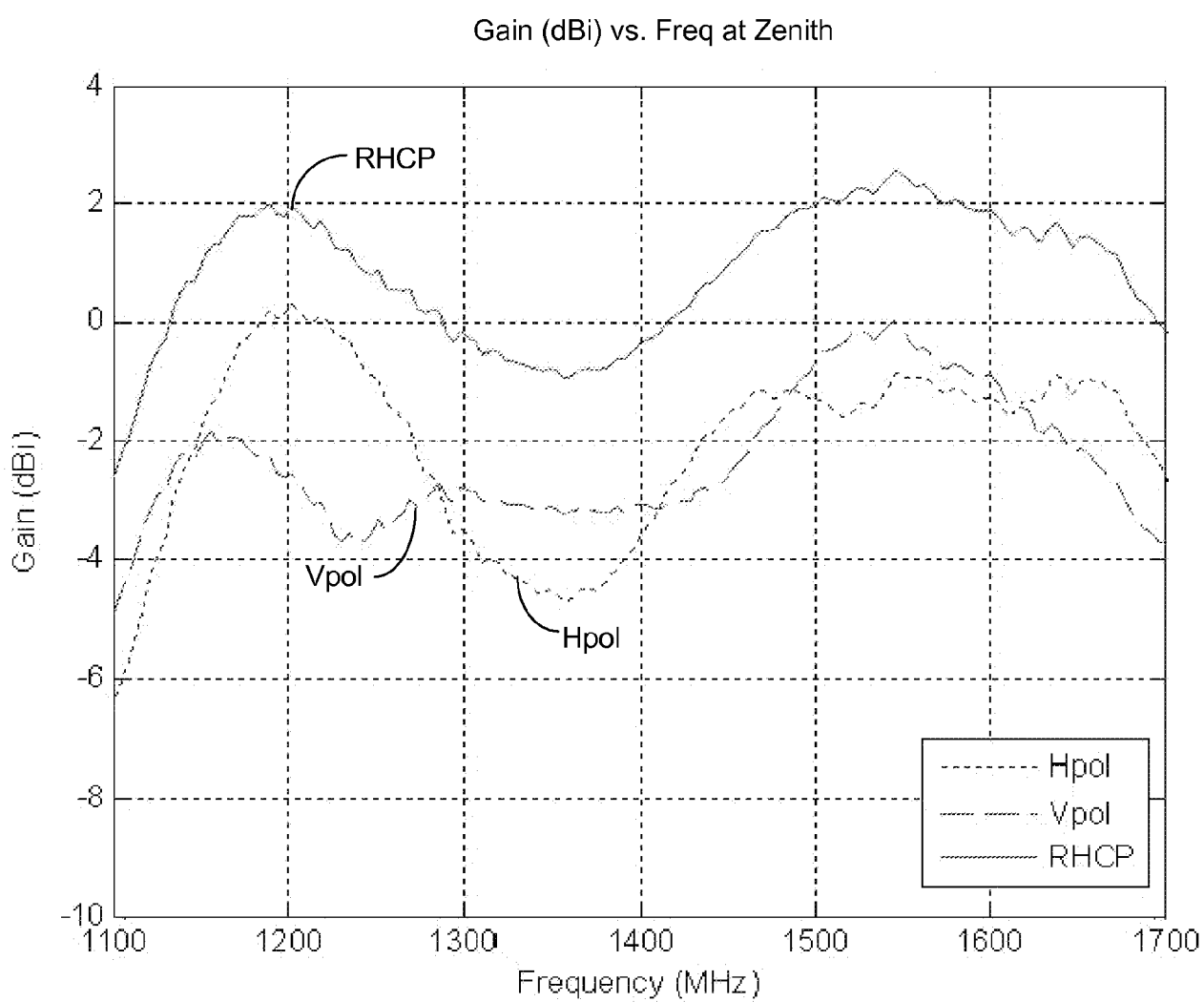
FIG. 5D is a graph of the gain versus frequency at zenith for an exemplary inverted-L multi-band antenna, according to some embodiments.
Figure 5E:
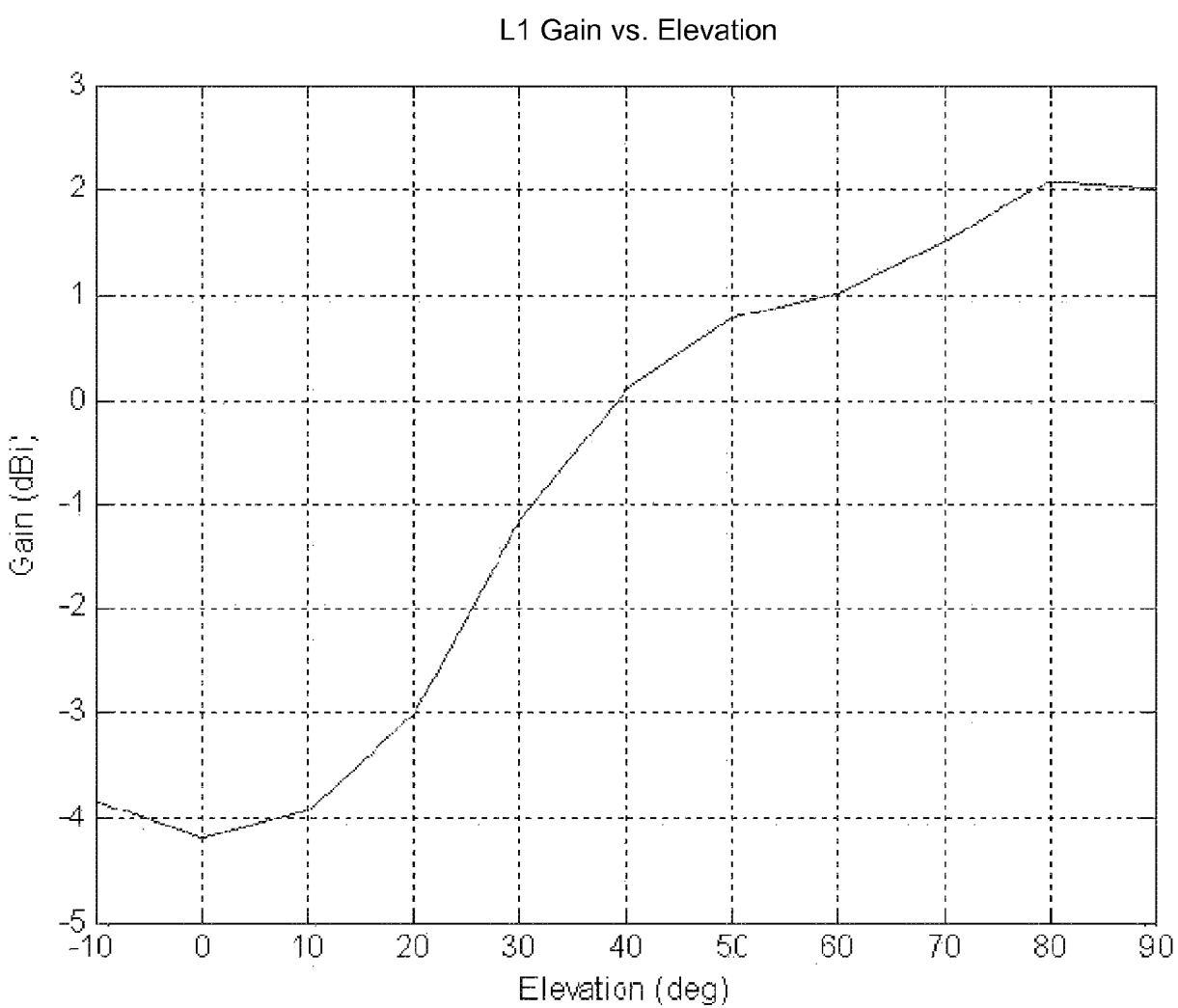
FIG. 5E is a graph of the L1 gain versus elevation for an exemplary inverted-L multi-band antenna, according to some embodiments.
Figure 5F:
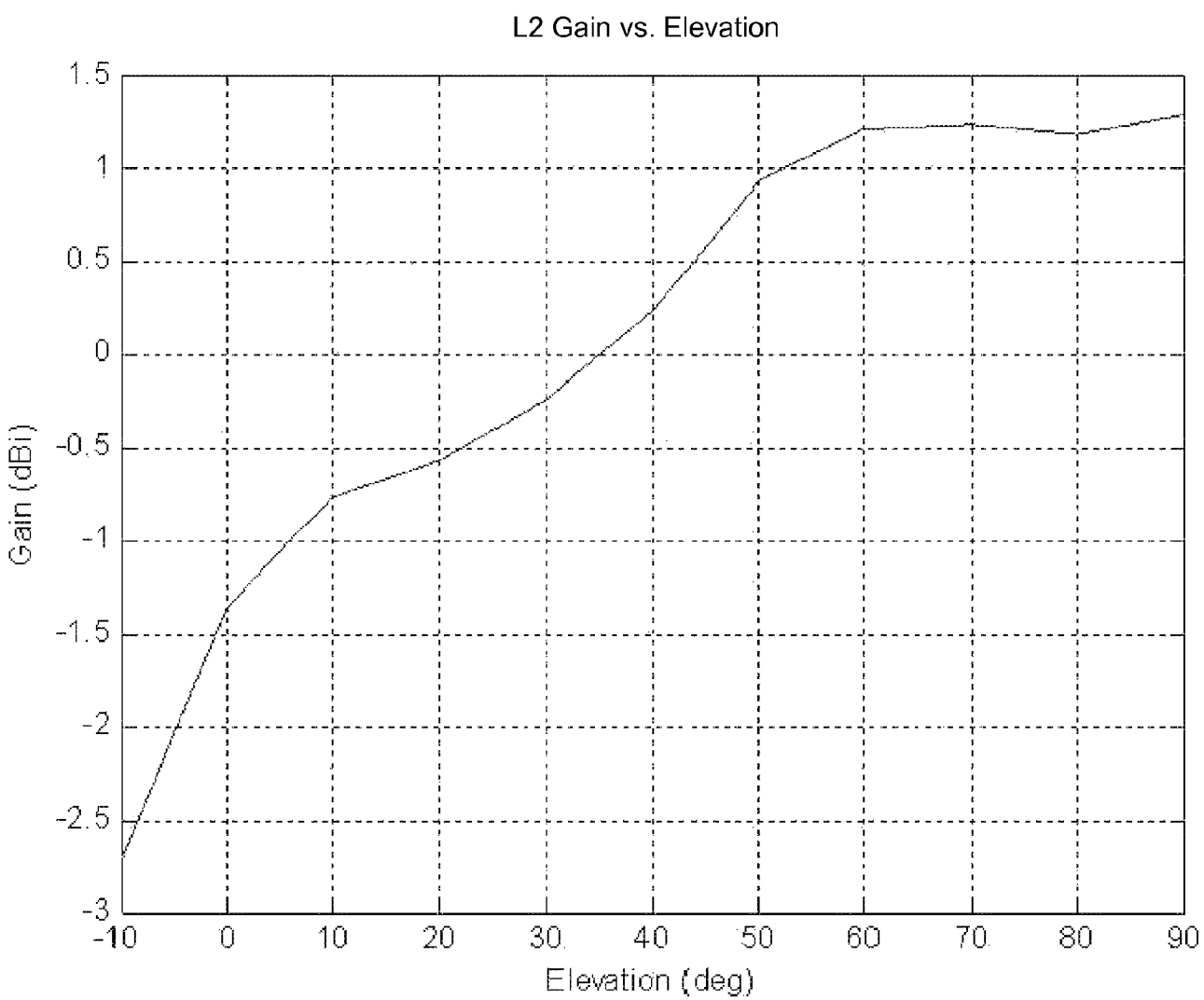
FIG. 5F is a graph of the L2 gain versus elevation for an exemplary inverted-L multi-band antenna, according to some embodiments.

FIG. 5C is a graph 520 of the L2 gain (i.e., gain in the L2 band) versus elevation for an exemplary hook shape multi-band antenna, according to some embodiments. The graph 520 is similar to the graph 510 in FIG. 5B. The graph 550 in FIG. 5F illustrates the gain versus elevation for a similarly sized inverted-L antenna.

Note that the graphs in FIGS. 5A-5F reflect measurements made in a conventional anechoic room so that only direct and no reflected energy would reach the test antenna from the reference source antenna. Furthermore, the test antenna was mounted on a motorized positioner so that the angle of the incident wave could be altered.

Figure 6:
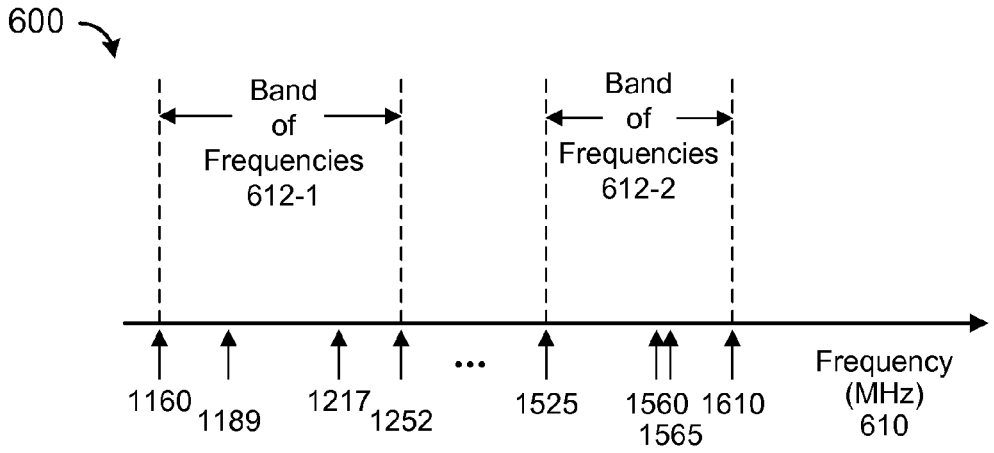
FIG. 6 shows bands of frequencies corresponding to a global satellite navigation system, according to some embodiments.

FIG. 6 is a diagram 600 showing bands 612 of frequencies corresponding to a global satellite navigation system, including the L1 band (1565 to 1585 MHz), the L2 band (1217 to 1237 MHz), the L5 band (1164 to 1189 MHz) and the L-band (1525 to 1560 MHz). Frequency 610 is shown on the x-axis. In some embodiments of the hook shape multi-band antenna, a first band of frequencies 612-1 includes 1160-1252 MHz and a second band of frequencies 612-2 includes 1525-1610 MHz. The central frequencies (also called the band center frequencies) of these bands are 1206 MHz and 1567.5 MHz, respectively. For purposes of computing desired antenna properties, approximate central frequencies (e.g., 1206 MHz and 1567 MHz) may be used instead of their exact values. The hook shape multi-band antenna assembly (i.e., the hook shape elements, associated matching network and combining network) has low return loss (e.g., less than ten percent) in both the first band of frequencies 612-1 and the second band of frequencies 612-2. In addition, the first band of frequencies 612-1 encompasses the L2 and L5 bands, and the second band of frequencies 612-2 encompasses the L1 band and L-band. Thus, a single hook shape multi-band antenna is able to transmit and/or receive signals in these four GNSS bands.

Figure 7:
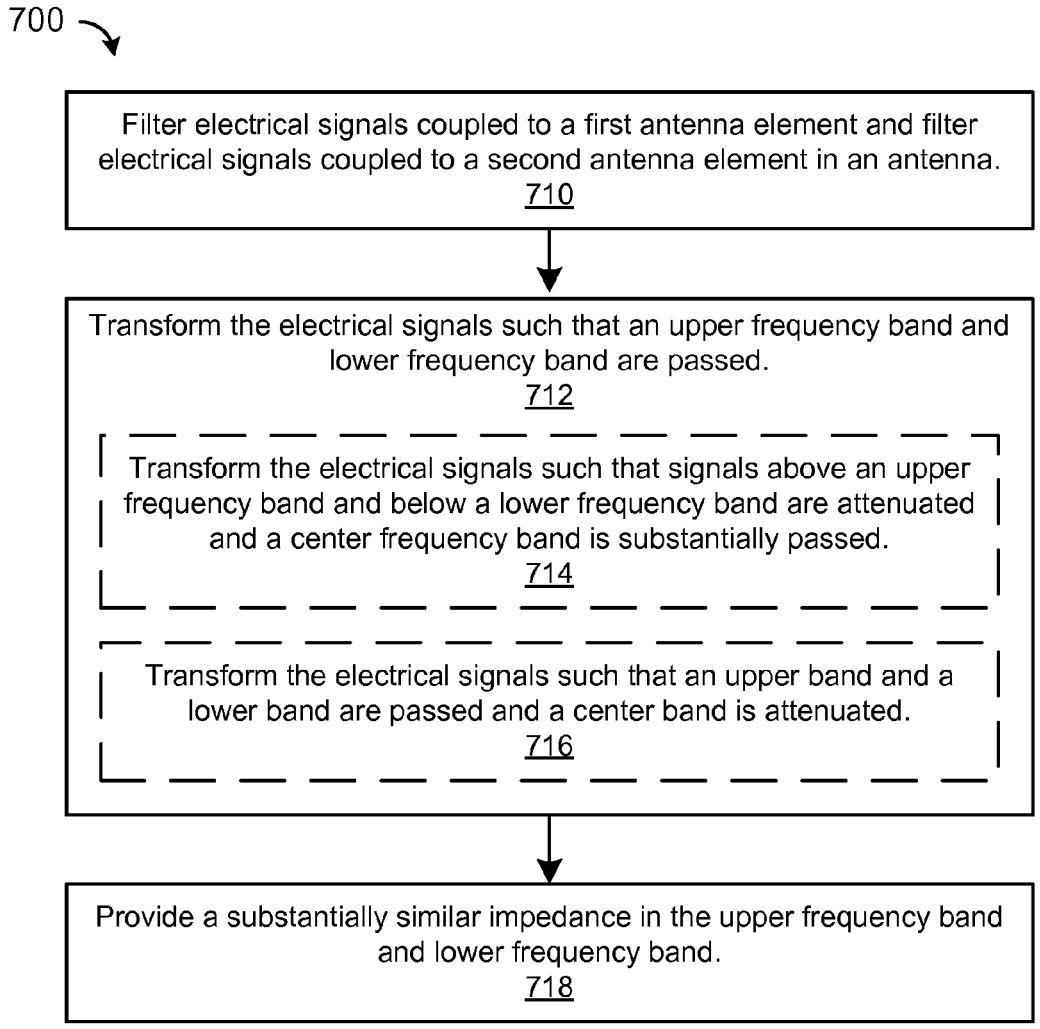
FIG. 7 is a flow chart illustrating an embodiment of a method of using a lumped element impedance matching circuit for a multi-band antenna, according to some embodiments.

Attention is now directed towards embodiments of processes of using a multi-band antenna with lumped element impedance matching. FIG. 7 is a flow chart illustrating a method 700 of using a hook shape multi-band antenna. The method includes filtering electrical signals coupled to a first antenna element and filtering electrical signals coupled to a second antenna element in an antenna (710). In some embodiments, the method includes filtering electrical signals received from (or sent to) each of the antenna elements (e.g., all four antenna elements 102-1 to 102-4, FIG. 2B) of the multi-band antenna. Circuitry for accomplishing this is shown in FIG. 3B, as well as other figures of this document, as discussed above and below. The method includes transforming the electrical signals such that an upper frequency band and a lower frequency band are passed (712). In some embodiments, the method includes transforming the electrical signals such that signals above an upper frequency band and below a lower frequency band are attenuated and a center frequency band is substantially passed (714). In some embodiments, the method includes transforming the electrical signals such that an upper band and a lower band are passed and a center band is attenuated (716). In some embodiments, the method provides a substantially similar impedance in two sub-bands (e.g., sub-bands 612-1 and 612-2 of FIG. 6) of the center frequency band (718).

In some embodiments, the method 700 of using a hook shape multi-band antenna may include fewer or additional operations. An order of the operations may be changed. At least two operations may be combined into a single operation.

Figure 8:
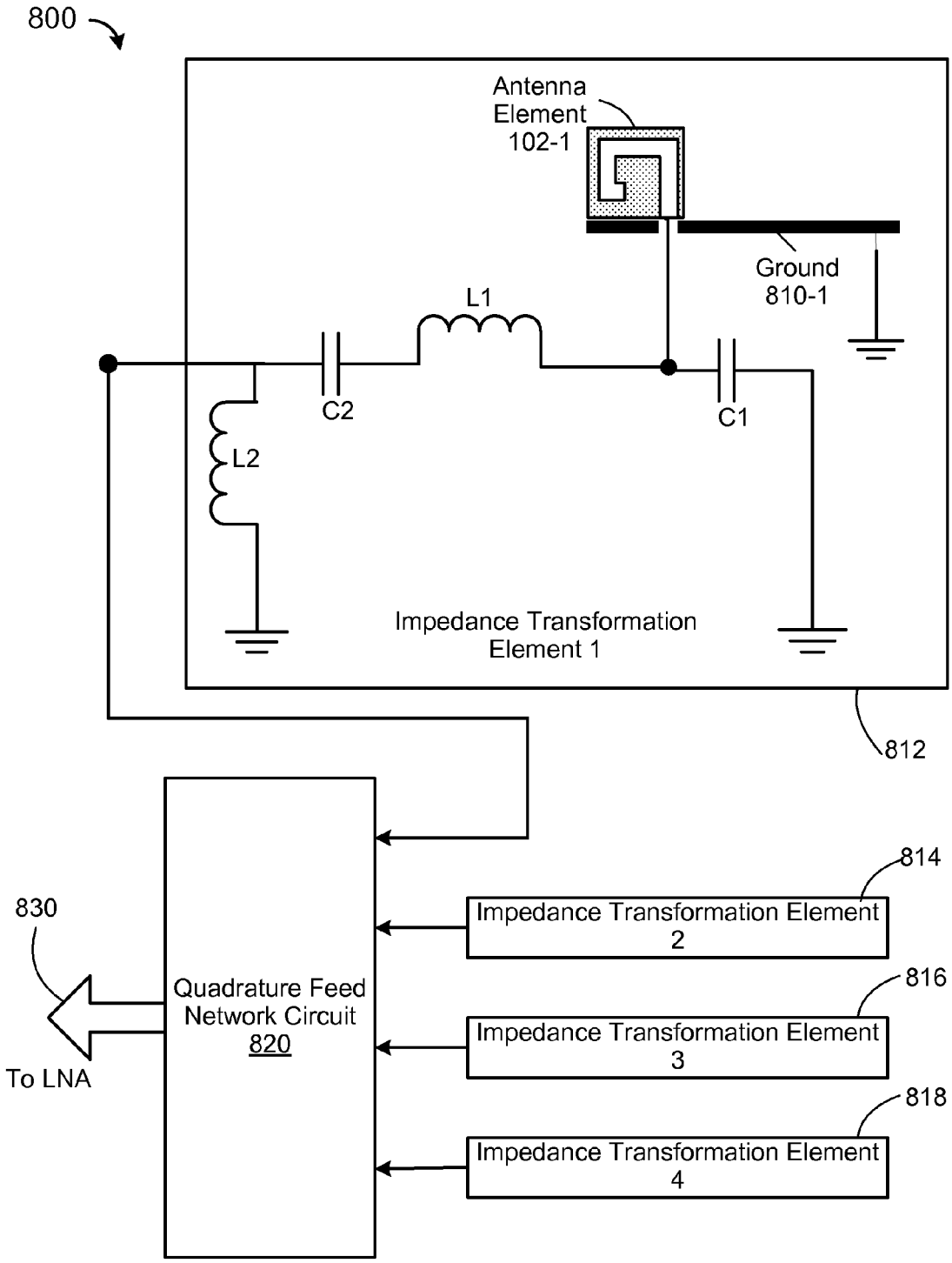
FIG. 8 is mixed block and circuit diagram of an embodiment of a system having a quad multi-band hook shape antenna including lumped element impedance matching circuits, with a combining network and a low noise amplifier, according to some embodiments.

FIG. 8 depicts a system 800 having a quad hook shape multi-band antenna including lumped element impedance matching elements 812, 814, 816, and 818, with a quadrature feed network circuit 820 and a low noise amplifier (LNA) 830. In the impedance matching element 812, the hook shape antenna element 102-1 is coupled to an impedance matching circuit (e.g., as illustrated in FIG. 8). An output of the impedance transformation element 812 is coupled to the quadrature feed network circuit 820. The quadrature feed network circuit 820 is coupled to the LNA 830. Similarly second (814), third (816), and fourth (818) impedance transformation elements each comprise a hook shape antenna element coupled to an impedance matching circuit, and are coupled to the quadrature feed network circuit 820. In some embodiments, the system 800 is implemented using lumped element impedance matching circuits. In some embodiments, the system 800 (excluding the antenna elements 102) is implemented on a single compact circuit board having a diameter of about six inches. In some embodiment, such a circuit board provides a desirable gain pattern for GNSS reception. By making the diameter larger or smaller, one may alter the gain pattern to provide more gain at lower elevations and less at high elevations or vice versa. The exact effect will vary with frequency. In a particular implementation, the antenna element impedance characteristics were found to be very weak functions of the circuit board (and hence the ground plane) diameter. In some embodiments, the system 800 is implemented on a compact circuit board having a diameter of between approximately three inches and six inches. In some embodiments, the system 800 is implemented on a compact circuit board having a diameter of between approximately five inches and seven inches. In some embodiments, the system 800 is implemented on a compact circuit board having a diameter of between approximately three inches and eight inches. In some embodiments, the system 800 is implemented on a compact circuit board having a diameter of between approximately two inches nine inches. In some embodiments, the system 800 is implemented on a compact circuit board having a diameter between approximately one inch and twelve inches. Embodiments with a compact circuit board having a diameter of less than three inches (e.g., between approximately 1 inch and three inches in diameter) may be used with smaller hook shape antenna elements than would be appropriate for the frequency bands discussed above, and thus would be appropriate for receiving and/or transmitting in higher frequency bands than the frequency bands discussed above. An example of sizing the hook shape antenna elements as a function of the wavelength of the center frequency of a band of frequencies to be received or transmitted is discussed above.

Figure 9A:
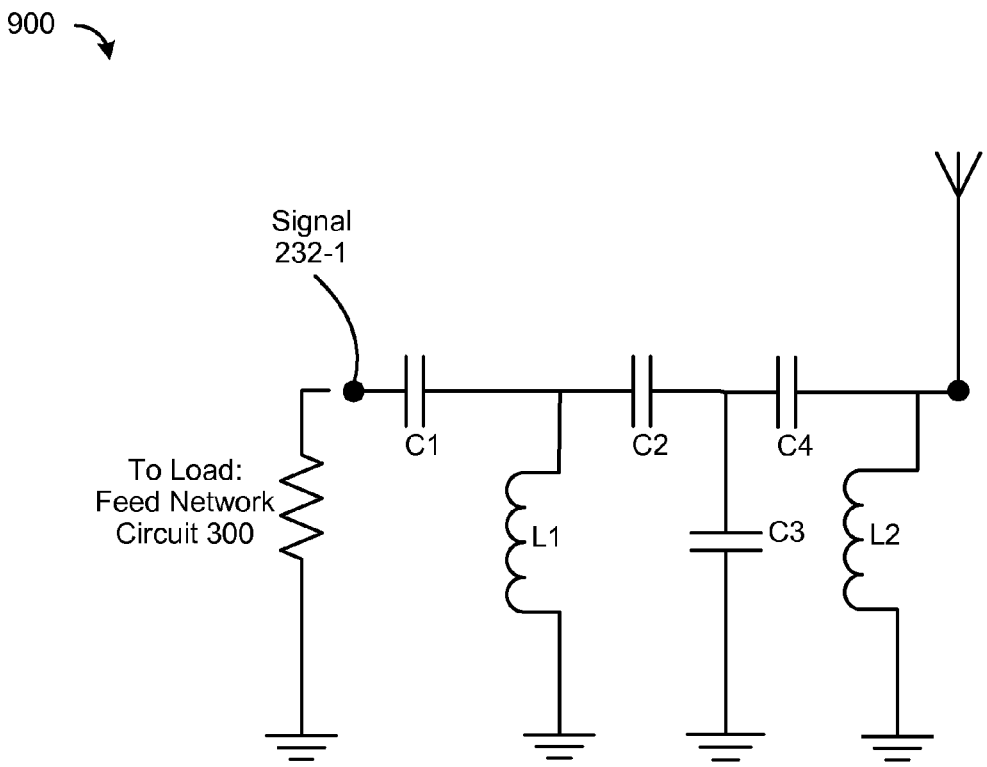
FIGS. 9A and 9B show alternative embodiments of an impedance matching circuit, according to some embodiments.
Figure 9B:
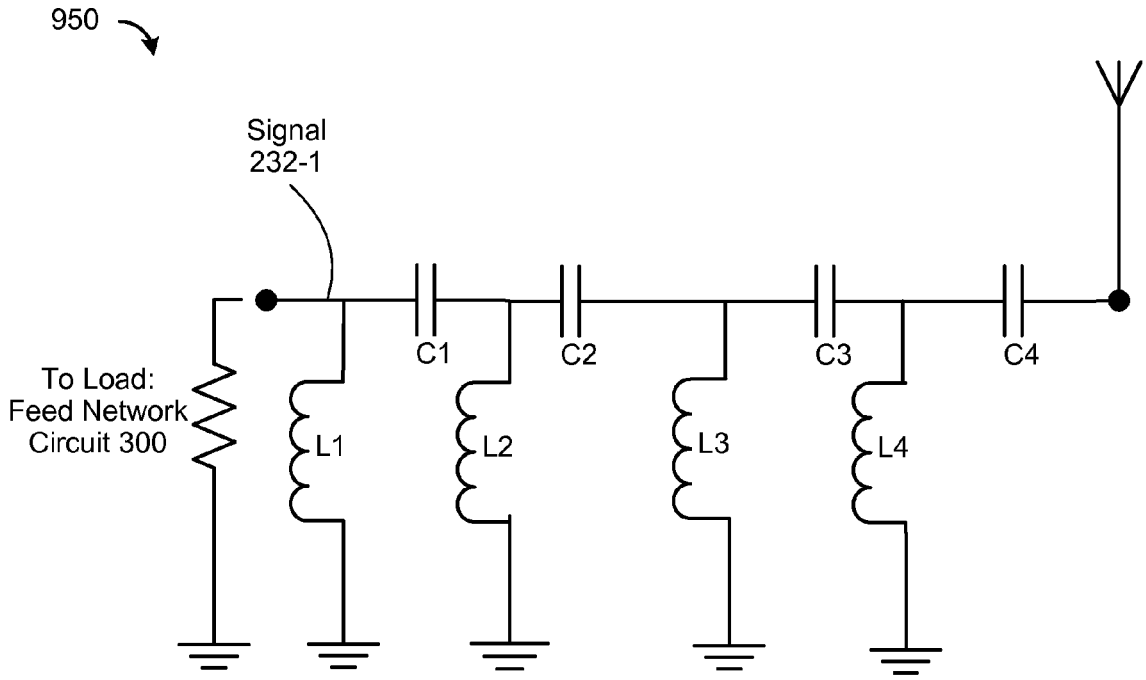

FIGS. 9A and 9B show alternative impedance matching circuits. FIG. 9A shows a circuit 900 for a six-pole shared-element impedance matching circuit, according to some embodiments. FIG. 9B shows a circuit 950 for an eight-pole shared-element impedance matching circuit, according to some embodiments. In some embodiments, the impedance matching circuits described may include fewer or additional elements or poles. An order of the elements may be changed. At least two elements may be combined into a single element.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. An antenna for receiving satellite signals, comprising:

a ground plane;

a first antenna element and a second antenna element, wherein the first antenna element and the second antenna element are electrically separate from one another;

a first impedance matching circuit coupled to the first antenna element, wherein the first impedance matching circuit includes a first plurality of filters; and a second impedance matching circuit coupled to the second antenna element, wherein the second impedance matching circuit includes a second plurality of filters, wherein the first and second antenna elements each include:

an insulating substrate having a specified thickness and a specified dielectric constant, the insulating substrate arranged in a plane substantially perpendicular to the ground plane; and parallel components of conducting material on both sides of the insulating substrate;

each parallel component configured in a single hook shape in a plane substantially perpendicular to the ground plane and including:

a first segment substantially perpendicular to the ground plane;

a second segment coupled to the first segment, extending away from a central vertical axis of the antenna, and substantially parallel to the ground plane;

a third segment coupled to the second segment and substantially perpendicular to the ground plane; and a fourth segment coupled to the third segment and substantially parallel to the ground plane, the fourth segment extending from the third segment toward the central vertical axis of the antenna;

wherein the first and second antenna elements are configured for receiving radiation that is circularly polarized.

2. The antenna of claim 1, wherein each of the first and second impedance matching circuits include:

a respective low pass filter; and a respective high pass filter.

3. The antenna of claim 2, wherein, for each of the first and second impedance matching circuits, the respective low pass filter and the respective high pass filter are coupled in series.

4. The antenna of claim 2, wherein at least one of the first and second impedance matching circuits provides an impedance of substantially 50 Ohms at a center frequency of both a first frequency band and a second, higher frequency band.

5. The antenna of claim 1, wherein:

at least one of the first and second antenna elements increases the gain of signals received at elevations substantially at the horizon relative to an antenna having inverted-L shaped antenna elements with radiating elements that are parallel to the ground plane.

6. The antenna of claim 1, including a feed network circuit coupled to the first impedance matching circuit and the second impedance matching circuit, wherein the feed network circuit has a combined output corresponding to the signals received by the first antenna element and the second antenna element.

7. The antenna of claim 1, wherein the first antenna element and the second antenna element are arranged substantially along a first axis of the antenna.

8. The antenna of claim 1, including:

a third antenna element and a fourth antenna element, wherein the third antenna element and the fourth antenna element are electrically distinct from one another and are both configured in a hook shape, and wherein the hook shape of each respective antenna element is formed in a plane substantially perpendicular to the ground plane;

a third impedance matching circuit coupled to the third antenna element, wherein the third impedance matching circuit includes a third plurality of filters; and a fourth impedance matching circuit coupled to the fourth antenna element, wherein the fourth impedance matching circuit includes a fourth plurality of filters.

9. The antenna of claim 8, wherein:

the first antenna element and the second antenna element are arranged substantially along a first axis of the antenna, and the third antenna element and the fourth antenna element are arranged substantially along a second axis of the antenna.

10. The antenna of claim 9, wherein the first axis and the second axis are substantially perpendicular to each other.

11. The antenna of claim 8, including a feed network circuit coupled to the first impedance matching circuit, the second impedance matching circuit, the third impedance matching circuit, and the fourth impedance matching circuit, wherein the feed network circuit has a combined output corresponding to the signals received by the first antenna element, the second antenna element, the third antenna element, and the fourth antenna element.

12. The antenna of claim 11, wherein the feed network circuit is configured to phase shift received signals from a respective antenna element relative to received signals from neighboring antenna elements in the antenna by substantially 90 degrees.

13. The antenna of claim 12, wherein the radiation is right hand circularly polarized radiation.

14. The antenna of claim 11, wherein the feed network circuit is configured to phase shift received signals from a respective antenna element relative to received signals from neighboring antenna elements in the antenna.

15. The antenna of claim 8, wherein the first antenna element, the second antenna element, the third antenna element, and the fourth antenna element are configured to receive radiation that is circularly polarized.

16. The antenna of claim 8, wherein the antenna is configured to have a substantially hemispherical gain.

17. The antenna of claim 16, wherein the substantially hemispherical gain is in the range of 3 dB isotropic.

18. The antenna of claim 1, further comprising:

a feed network circuit coupled to the first and second impedance matching circuits;

a low-noise amplifier coupled to the feed network circuit; and a sampling circuit coupled to the low-noise amplifier.

19. The antenna of claim 1, wherein the hook shape of each antenna element increases the gain of signals received at elevations substantially at the horizon relative to an antenna having inverted-L shaped antenna elements with radiating elements that are parallel to the ground plane.

20. An antenna for receiving satellite signals, comprising:

a ground plane;

a first antenna element and a second antenna element, wherein the first antenna element and the second antenna element are electrically separate from one another;

a first impedance matching circuit coupled to the first antenna element, wherein the first impedance matching circuit includes a first plurality of filters; and a second impedance matching circuit coupled to the second antenna element, wherein the second impedance matching circuit includes a second plurality of filters, wherein the first and second antenna elements each include:

an insulating substrate having a specified thickness and a specified dielectric constant, the insulating substrate arranged in a plane substantially perpendicular to the ground plane; and parallel components of conducting material on both sides of the insulating substrate;

each parallel component configured in a single hook shape in a plane substantially perpendicular to the ground plane;

wherein the first and second antenna elements are configured for receiving radiation that is circularly polarized.

* * * * *